US011125252B2

(12) United States Patent
Carl et al.

(10) Patent No.: US 11,125,252 B2
(45) Date of Patent: Sep. 21, 2021

(54) HYDRAULIC SYSTEMS FOR HEAVY EQUIPMENT

(71) Applicant: PACCAR Inc, Bellevue, WA (US)

(72) Inventors: Donald Carl, Bellevue, WA (US); Bill Werner, Bellevue, WA (US); Floyd Hendrix, Bellevue, WA (US); Jacob Smarker, Bellevue, WA (US)

(73) Assignee: PACCAR INC, Bellevue, WA (US)

( * ) Notice: Subject to any disclaimer, the term of this patent is extended or adjusted under 35 U.S.C. 154(b) by 0 days.

(21) Appl. No.: 16/800,973

(22) Filed: Feb. 25, 2020

(65) Prior Publication Data

US 2020/0325917 A1 Oct. 15, 2020

Related U.S. Application Data

(60) Provisional application No. 62/833,601, filed on Apr. 12, 2019.

(51) Int. Cl.

| | |
|---|---|
| ***F15B 15/04*** | (2006.01) |
| ***F15B 1/26*** | (2006.01) |
| ***F15B 15/18*** | (2006.01) |

(52) U.S. Cl.

CPC ..... *F15B 15/04* (2013.01); *F15B 1/26* (2013.01); *F15B 15/18* (2013.01); *F15B 2211/45* (2013.01)

(58) Field of Classification Search

CPC .. F15B 15/04; F15B 1/26; F15B 15/18; F15B 2211/45; F15B 2211/5153; F15B 2211/56

See application file for complete search history.

(56) References Cited

U.S. PATENT DOCUMENTS

| | | | | |
|---|---|---|---|---|
| 3,630,243 | A * | 12/1971 | Hamilton | A01G 23/006 144/163 |
| 3,854,766 | A * | 12/1974 | Jordan | F15B 1/033 294/206 |
| 4,090,693 | A * | 5/1978 | Hoehn | B66D 1/44 192/12 B |
| 4,337,926 | A * | 7/1982 | Dehaan | B66D 1/44 188/105 |
| 4,396,215 | A * | 8/1983 | McCutcheon | B66C 3/16 294/198 |
| 4,746,100 | A * | 5/1988 | Davenport | B66D 5/26 188/106 F |
| 5,558,380 | A * | 9/1996 | Meyer | B66C 1/585 294/106 |
| 7,614,843 | B2 * | 11/2009 | Hested | B66C 1/585 294/104 |
| 9,745,178 | B2 * | 8/2017 | Muraoka | E02F 3/964 |
| 10,066,644 | B2 * | 9/2018 | Opdenbosch | F15B 11/0445 |

(Continued)

*Primary Examiner* — Thomas E Lazo

(74) *Attorney, Agent, or Firm* — Seed IP Law Group LLP

(57) ABSTRACT

A hydraulic system may include a reservoir of hydraulic fluid, a hydraulic pump, a directional control valve, a hydraulic work loop, a bypass valve, and a hydraulic motor, as well as a plurality of hydraulic conduits interconnecting such components. When excessive hydraulic backpressures are encountered, the system may employ one or more bypass valves and one or more bypass conduits to automatically, and in an on-demand manner, return some or all of the hydraulic fluid from the hydraulic motor to the hydraulic reservoir without the hydraulic fluid passing through flow constrictions causing the excessive hydraulic backpressures.

17 Claims, 14 Drawing Sheets

(56) References Cited

U.S. PATENT DOCUMENTS

| | | | | |
|---|---|---|---|---|
| 2013/0129460 | A1* | 5/2013 | Gabibulayev | E02F 9/2095 414/699 |
| 2016/0186787 | A1* | 6/2016 | Opdenbosch | F15B 11/0445 60/459 |

* cited by examiner

HYDRAULIC SYSTEMS FOR HEAVY EQUIPMENT

BACKGROUND

Technical Field

The present disclosure relates generally to open-loop hydraulic systems on mobile construction, forestry, service, and agricultural equipment (including track-type or wheeled machinery, construction equipment, or vehicles, including tractors, skidders, bulldozers, loaders, graders, backhoes, harvesters, feller-bunchers, forwarders, and on-road or off-road trucks) used to power subsystems of the equipment and/or hydraulically-powered attachments to the equipment.

Description of the Related Art

Heavy equipment, such as track-type or wheeled machinery, construction equipment, or vehicles, including tractors, skidders, bulldozers, loaders, graders, backhoes, harvesters, feller-bunchers, forwarders, and on-road or off-road trucks, often comprises hydraulic systems for driving various hydraulically-powered subsystems, attachments, or components thereof. Such hydraulic systems typically include a tank or reservoir of hydraulic fluid, a hydraulic pump, and a valve stack including a plurality of control valves for controlling the flow of the hydraulic fluid between the reservoir, the pump, and/or the hydraulically-powered components. Traditionally, such valve stacks included a plurality of valves, with each of the valves selected or optimized for use with the specific hydraulically-powered components to which it was coupled, and to which it controlled the flow of the hydraulic fluid.

FIG. 1 illustrates one example of a hydraulic system including a tank of hydraulic fluid, a pump, a single-acting hydraulic cylinder, a double acting hydraulic cylinder, a unidirectional hydraulic motor, a bi-directional hydraulic motor, and a stack valve (or "valve stack") that includes a plurality of individual hydraulic control valves (or "valve sections") that are packaged together in a single housing with common connections to the hydraulic pump and tank. FIG. 2 illustrates another example of a hydraulic system that is similar to the hydraulic system of FIG. 1, except that it includes four separately-housed hydraulic control valves rather than four valve sections within a single housing. The particular hydraulic actuators illustrated in the work loops of both FIG. 1 and FIG. 2 (single-acting cylinder, double-acting cylinder, unidirectional motor, and bi-directional motor) are examples only, and real-world hydraulic systems may have any number of work loops (more or less than the four shown) and may have any combination of hydraulic actuator types (not necessarily limited to the four types shown in the illustrations).

In recent years, however, there has been a trend in the industry for machine manufacturers (which may be referred to as "OEMs") to simplify such systems and their control valves in particular, such as by reducing the number of specialized control valve types available and/or included in the system. This trend may be driven in part by desires to simplify maintenance or serviceability of the systems, to simplify supply chains and/or inventory management, and to streamline or consolidate component parts used across product lines. While OEMs may realize some or all of the aforementioned benefits resulting from such changes, there are sometimes unintended and/or undesirable side effects.

For example, as noted above, in older hydraulic systems having a plurality of directional control valves, each of the directional control valves could be, and often was, selected or optimized for use with the specific hydraulically-powered component to which it was coupled, and to which it controlled the flow of the hydraulic fluid. In contrast, newer hydraulic systems having fewer directional control valve types available and/or included in a machine may not provide valves tailored to the specific components they control the flow of hydraulic fluid to. In many of these newer systems, OEMs typically select or optimize the valve types offered and/or included for use with the most common and/or most profitable hydraulically-powered components expected to be incorporated into and powered by the hydraulic system. Additionally or alternatively, OEMs may select or optimize the control valves and/or related systems for characteristics that are especially important to particular hydraulically-powered subsystems or attachment types, but that are not as important to or that may be detrimental to, other types of subsystems or attachments. One example of a special characteristic that OEMs may prioritize over other considerations is the avoidance, or reduction of risk of, cavitation.

The hydraulically-powered subsystems or attachments that benefit from a focus on anti-cavitation are generally driven by hydraulic cylinders, generating mechanical work in the form of linear motion or exerting linear forces. However, design focus on anti-cavitation may have the side effect of creating or increasing system back-pressure, which may reduce the overall performance, safety, and consistency of other types of hydraulically-powered subsystems, attachments, or components. The hydraulically-powered subsystems, attachments, or components that may suffer the most from high hydraulic system back-pressures are generally driven by hydraulic motors generating mechanical work in the form of rotation or exerting rotational torques.

FIG. 3 illustrates the hydraulic system of FIG. 1, but showing some of the challenges frequently found in recently-developed OEM mobile hydraulic systems. As illustrated in FIG. 3, such a hydraulic system will often include flow constrictions or restrictions, such as within the control valve stack as a result of the configuration of the valve sections, as well as within a hydraulic flow path from the valve stack to the tank of hydraulic fluid. Some of the flow constrictions or restrictions may be by design while others may be inadvertent. Flow constrictions or restrictions that are not inside the control valve stack or within a particular individual system control valve may be a result of plumbing, filters, coolers, or other components or features therein. Regardless of the number or location of flow constrictions or restrictions, the cumulative effect of such flow constrictions can cause backpressures in the hydraulic system that are undesirably or even unacceptably high for certain types of hydraulically-powered subsystems, attachments, or components.

FIG. 4 illustrates the hydraulic system of FIG. 2, but shows some of the challenges frequently found in recently-developed OEM mobile hydraulic systems. As illustrated in FIG. 4, such a hydraulic system will often include flow constrictions or restrictions, such as within the control valves as a result of the configuration of the valves, as well as within hydraulic flow path(s) from the valves to the tank of hydraulic fluid. Some of the flow constrictions or restrictions may be by design while others may be inadvertent. Flow constrictions or restrictions that are not inside the control valves may be a result of plumbing, filters, coolers, or other components or features therein. As illustrated in FIG. 4, such flow constrictions may impact or affect only one work loop (or "work circuit") controlled by a single one of the system control valves, and not the other work loops, or may impact or affect a plurality of work loops controlled by a plurality of the valves, but not all of the work loops. Regardless of the number or location of flow constrictions or restrictions, the cumulative effect of such flow constrictions can cause backpressures in the hydraulic system that are undesirably or even unacceptably high for certain types of hydraulically-powered subsystems, attachments, or components.

BRIEF SUMMARY

The embodiments described herein may be used to mitigate or eliminate the negative impacts of elevated system back pressure on machine subsystems or attachments, such as by bypassing some or all of the hydraulic system flow around flow constrictions in the machine hydraulic system that cause elevated system back pressures.

A machine including or implementing the features described herein may be a piece of heavy, mobile, construction, service, forestry, or agricultural equipment. Specific types of machines may include (but are not necessarily limited to): on-road service trucks, mobile forestry equipment such as track skidders, wheel skidders, hybrid skidders (which may have tracks and wheels or tracks only but steer by articulation of the entire machine or articulation of one or more axle sets or articulable track sets), harvesters, feller-bunchers, and forwarders, and mobile construction equipment such as track-type tractors and related machines (e.g., bulldozers, track-type tractor-based pipelayers, track loaders, compact track loaders, and track utility vehicles) and wheeled construction machines (e.g., wheel loaders, skid-steer loaders, graders, off-road trucks, and off-road wheeled utility and/or service vehicles).

In some embodiments, a hydraulic system includes a work device, a flow constriction, and a hydraulic connection placed in a return side of the system downstream of the work device and upstream of the flow constriction, where the hydraulic connection includes a valve that, when needed, diverts some or all of the return flow from the work device around the flow constriction and back to a tank of hydraulic fluid, thereby mitigating degradation in performance, function, and/or safety that would otherwise arise due to the flow constriction.

A hydraulic system for powering a hydraulically-powered subsystem or attachment for a mobile construction, service, forestry, or agricultural machine may be summarized as comprising: a reservoir of hydraulic fluid; a hydraulic pump; a hydraulic directional control valve; a hydraulic bypass valve; a hydraulic actuator; a mechanical device mechanically coupled to be driven by the hydraulic actuator; a first hydraulic conduit that hydraulically couples the hydraulic pump to the reservoir; a second hydraulic conduit that hydraulically couples the hydraulic pump to the directional control valve; a third hydraulic conduit that hydraulically couples the directional control valve to the reservoir; a fourth hydraulic conduit that hydraulically couples the directional control valve to the hydraulic motor; a fifth hydraulic conduit that hydraulically couples the directional control valve to the hydraulic motor; a sixth hydraulic conduit that hydraulically couples either the third hydraulic conduit or the fourth hydraulic conduit to the bypass valve; and a bypass conduit that hydraulically couples the bypass valve to the reservoir.

The hydraulic actuator may be a hydraulic motor. The mechanical device may further comprise a winch mechanically coupled to be driven by the hydraulic motor, and the winch may include a break-away type attaching arrangement for a cable, wire, or rope.

A method of operating a hydraulic system for a mobile construction, service, forestry, or agricultural machine for improved performance of a hydraulically-powered subsystem or attachment of the machine may be summarized as comprising: commanding the subsystem or attachment to perform its designed function; switching a position of a directional control valve to allow a hydraulic fluid to flow from a hydraulic pump through the directional control valve; pumping the hydraulic fluid from a reservoir of the hydraulic fluid, through the directional control valve a first time, through a work loop, through the directional control valve a second time, and back to the reservoir; in response to a hydraulic backpressure created by a flow constriction exceeding a threshold pressure, switching a bypass valve to an open position to allow the hydraulic fluid to flow through the bypass valve and back to the reservoir without passing through the flow constriction.

DETAILED DESCRIPTION

Figure 1:
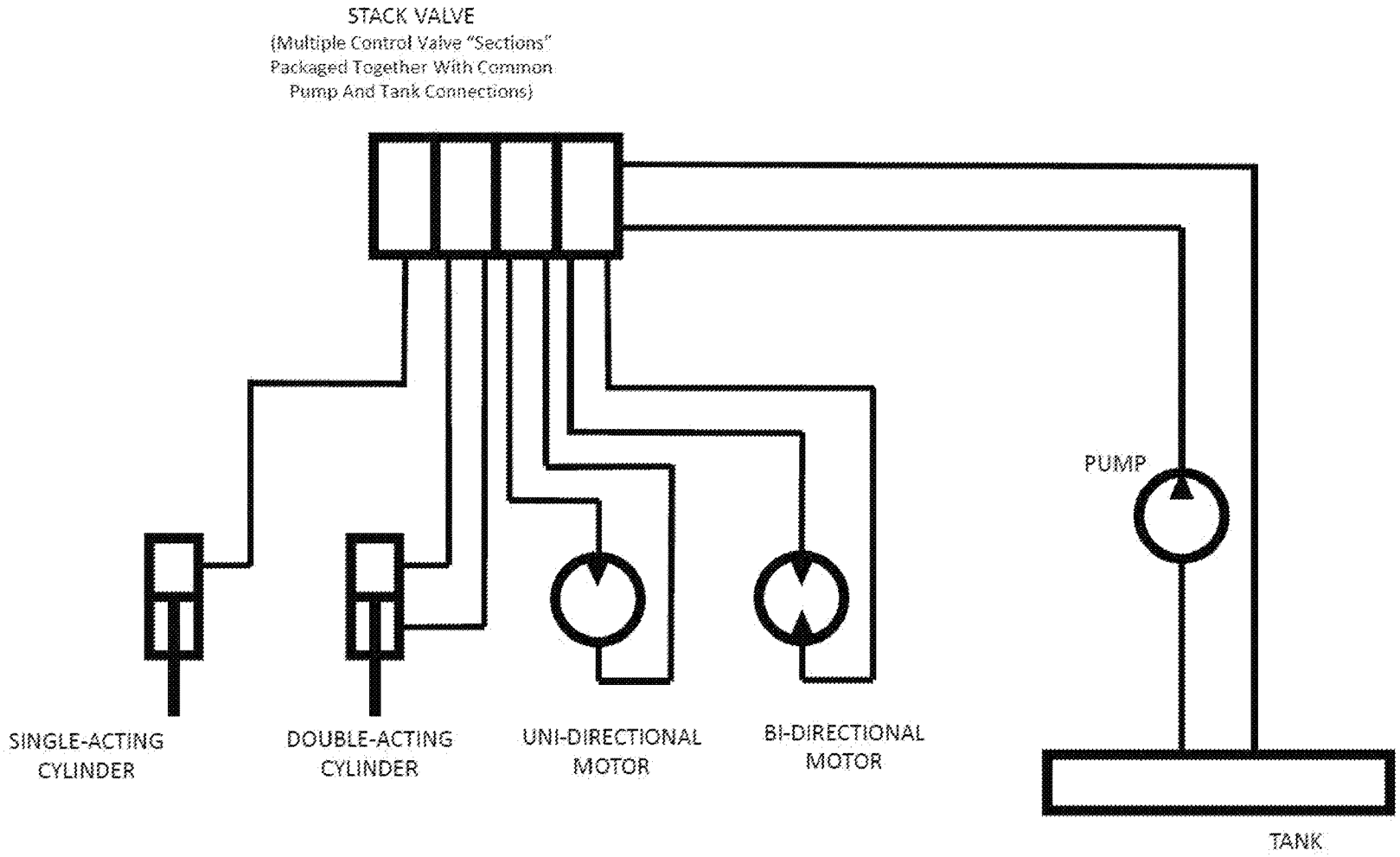
FIG. 1 illustrates a schematic diagram of a hydraulic system.
Figure 2:
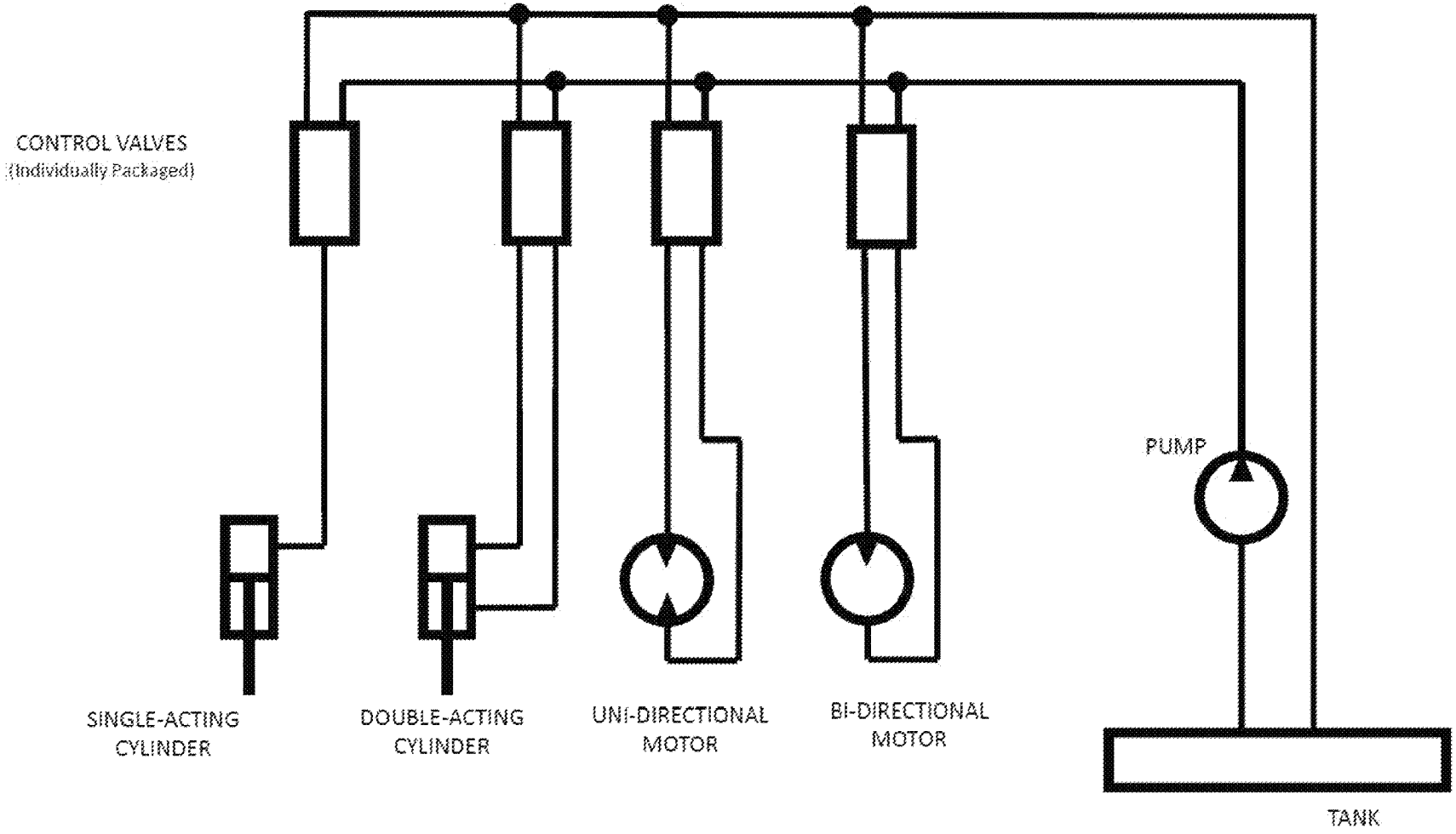
FIG. 2 illustrates a schematic diagram of another hydraulic system.

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with the technology have not been shown or described in detail to avoid unnecessarily obscuring descriptions of the embodiments.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments. Also, as used in this specification and the appended claims, the singular forms "a," "an," and "the" include plural referents unless the context clearly dictates otherwise. It should also be noted that the term "or" is generally employed in its sense including "and/or" unless the context clearly dictates otherwise.

The use of ordinals such as first, second and third does not necessarily imply a ranked sense of order, but rather may only distinguish between multiple instances of an act or structure.

Terms of geometric alignment may be used herein. Any components of the embodiments that are illustrated, described, or claimed herein as being aligned, arranged in the same direction, parallel, or having other similar geometric relationships with respect to one another have such relationships in the illustrated, described, or claimed embodiments. In alternative embodiments, however, such components can have any of the other similar geometric properties described herein indicating alignment with respect to one another. Any components of the embodiments that are illustrated, described, or claimed herein as being not aligned, arranged in different directions, not parallel, perpendicular, transverse, or having other similar geometric relationships with respect to one another, have such relationships in the illustrated, described, or claimed embodiments. In alternative embodiments, however, such components can have any of the other similar geometric properties described herein indicating non-alignment with respect to one another.

Various examples of suitable dimensions of components and other numerical values may be provided herein. In the illustrated, described, and claimed embodiments, such dimensions are accurate to within standard manufacturing tolerances unless stated otherwise. Such dimensions are examples, however, and can be modified to produce variations of the components and systems described herein. In various alternative embodiments, such dimensions and any other specific numerical values provided herein can be approximations wherein the actual numerical values can vary by up to 1, 2, 5, 10, 15 or more percent from the stated, approximate dimensions or other numerical values.

Figure 5:
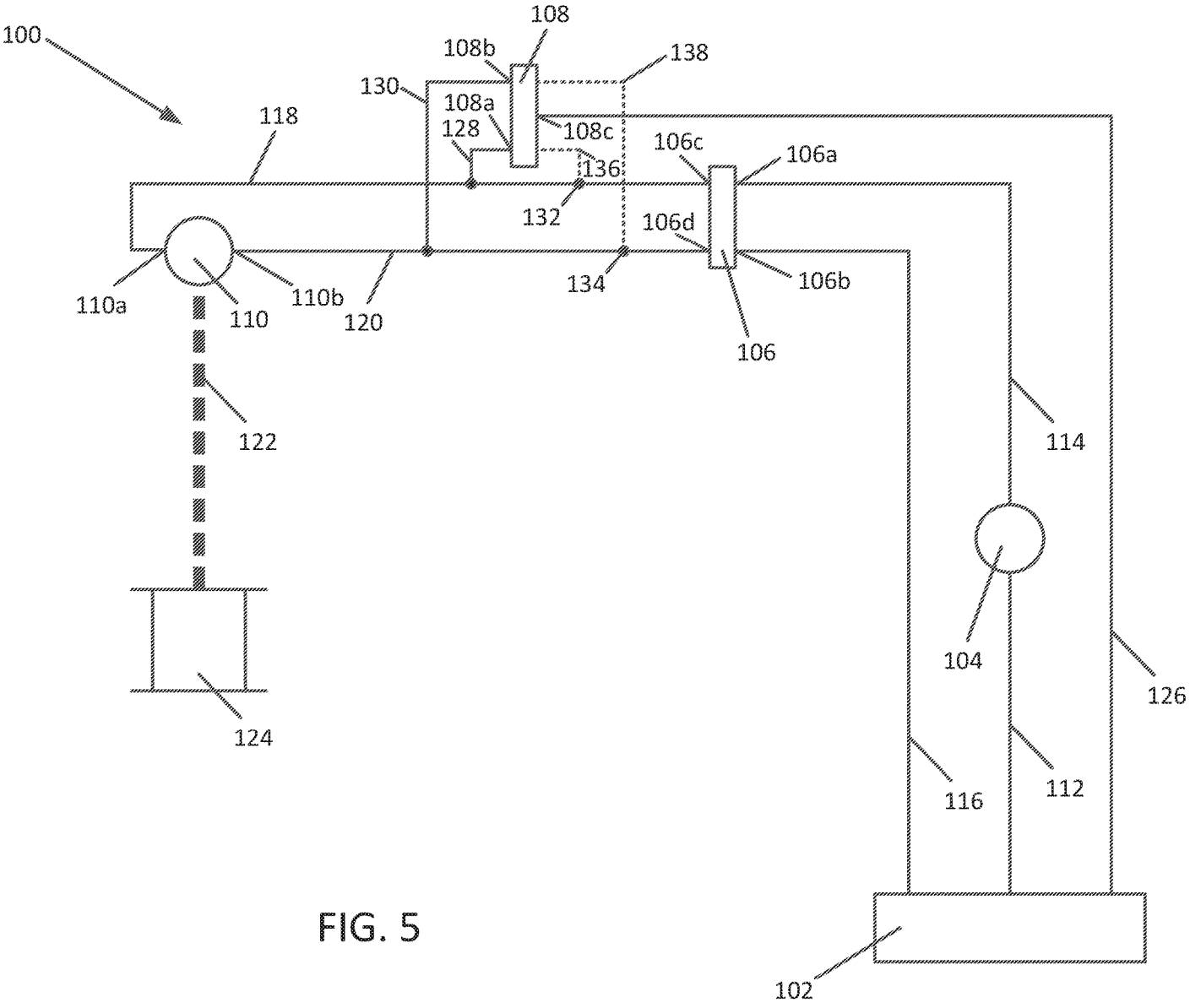
FIG. 5 illustrates a schematic diagram of another hydraulic system.

FIG. 5 illustrates a hydraulic system 100. As illustrated in FIG. 5, the hydraulic system 100 includes a tank or reservoir 102 of hydraulic fluid, as well as a hydraulic pump 104, a directional control valve 106, a bypass valve 108, and a hydraulic actuator, which may comprise a hydraulic motor 110. The reservoir 102 may be an enclosed or an open channel reservoir, and may include any tank, container, or other structure used to hold or store hydraulic fluid. The directional control valve 106 is a four-port, three-position valve. The directional control valve 106 includes a first fluid port 106*a*, a second fluid port 106*b*, a third fluid port 106*c*, and a fourth fluid port 106*d*. The first fluid port 106*a* is an inlet 106*a*, and the second fluid port 106*b* is an outlet 106*b*, to the directional control valve 106. Depending on the configuration or position of the directional control valve 106, the third fluid port 106*c* may be an inlet while the fourth fluid port 106*d* is an outlet, and the third fluid port 106*c* may be an outlet while the fourth fluid port 106*d* is an inlet.

The directional control valve 106 can be operated in one of, and can be actuated to switch between, three distinct configurations or positions. In a first one of the positions, the directional control valve 106 is closed and no working fluid flows through the directional control valve 106. In a second one of the positions, the first fluid port 106*a* is fluidically coupled to the third fluid port 106*c* and the second fluid port 106*b* is fluidically coupled to the fourth fluid port 106*d*. In the second position, fluid can flow through the directional control valve 106 from the first fluid port 106*a* to the third fluid port 106*c* and from the second fluid port 106*b* to the fourth fluid port 106*d*. Thus, in the second position, the third fluid port 106*c* is an outlet, and the fourth fluid port 106*d* is an inlet, to the directional control valve 106. In a third one of the positions, the first fluid port 106*a* is fluidically coupled to the fourth fluid port 106*d* and the second fluid port 106*b* is fluidically coupled to the third fluid port 106*c*. In the third position, fluid can flow through the directional control valve 106 from the first fluid port 106*a* to the fourth fluid port 106*d* and from the second fluid port 106*b* to the third fluid port 106*c*. Thus, in the third position, the third fluid port 106*c* is an inlet, and the fourth fluid port 106*d* is an outlet, to the directional control valve 106.

Directional control valves can be provided with and have a variety of configurations, and the configuration of a directional control valve selected for use in a hydraulic system may depend on its intended use in the system. Some directional control valves may be optimized for use in certain specific applications (e.g., for use in controlling operation of a hydraulic cylinder) but may have drawbacks when used in other applications (e.g., when used in controlling operation of a hydraulic motor). As the terminology is used herein, a cylinder directional control valve is a directional control valve that is designed, configured, structured, or optimized in some way for use with hydraulic cylinders, while a motor directional control valve is a directional control valve that is designed, configured, structured, or optimized in some way for use with hydraulic motors.

Figure 6:
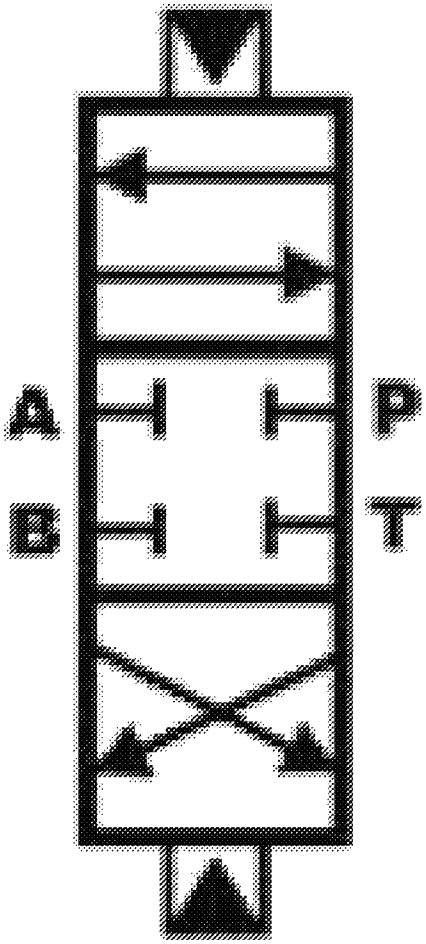
FIG. 6 illustrates a schematic diagram of a cylinder directional control valve.

FIG. 6 illustrates a schematic diagram of an example of a cylinder directional control valve. As illustrated in FIG. 6, the cylinder directional control valve is a four port, three position valve. A first one of the ports P is coupled to a source of high pressure hydraulic fluid such as a hydraulic pump. A second one of the ports T is coupled to a low pressure reservoir of hydraulic fluid such as a tank. A third one of the ports A is coupled to a first hydraulic conduit of a work loop of a hydraulic system. A fourth one of the ports B is coupled to a second hydraulic conduit of the work loop of the hydraulic system. In a first position of the cylinder directional control valve, as illustrated in FIG. 6, none of the four ports are coupled to one another, and no hydraulic fluid flows therethrough, and the cylinder directional control valve is closed. In a second position of the cylinder directional control valve illustrated in FIG. 6, port P is coupled to port A and port T is coupled to port B, such that hydraulic fluid can flow from port P to port A, through the first hydraulic conduit of the work loop to the second hydraulic conduit of the work loop, and then from port B to port T, to return to the tank. In a third position of the cylinder directional control valve illustrated in FIG. 6, port P is coupled to port B and port T is coupled to port A, such that hydraulic fluid can flow from port P to port B, through the second hydraulic conduit of the work loop to the first hydraulic conduit of the work loop, and then from port A to port T, to return to the tank.

Figure 7:
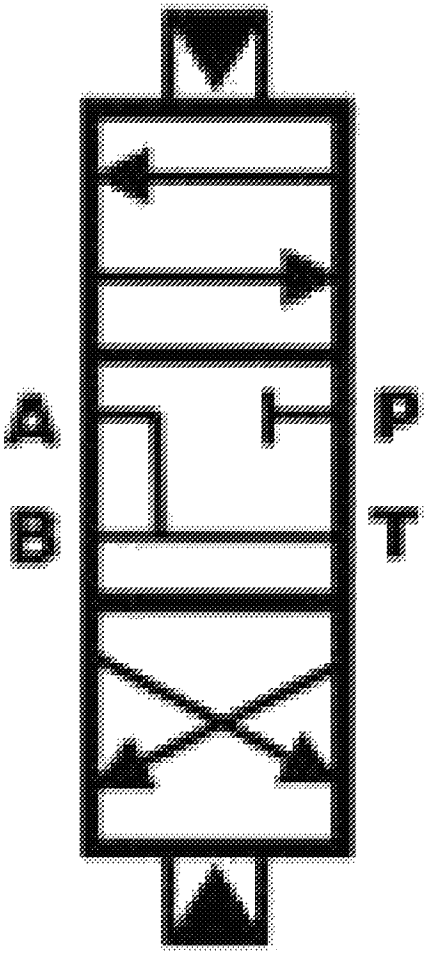
FIG. 7 illustrates a schematic diagram of a motor directional control valve.

FIG. 7, in contrast to FIG. 6, illustrates a schematic diagram of an example of a motor directional control valve. As illustrated in FIG. 7, the motor directional control valve is a four port, three position valve. A first one of the ports P is coupled to a source of high pressure hydraulic fluid such as a hydraulic pump. A second one of the ports T is coupled to a low pressure reservoir of hydraulic fluid such as a tank. A third one of the ports A is coupled to a first hydraulic conduit of a work loop of a hydraulic system. A fourth one of the ports B is coupled to a second hydraulic conduit of the work loop of the hydraulic system. In a first position of the motor directional control valve, as illustrated in FIG. 7, ports A, B, and T are hydraulically coupled to one another. In a second position of the motor directional control valve illustrated in FIG. 7, port P is coupled to port A and port T is coupled to port B, such that hydraulic fluid can flow from port P to port A, through the first hydraulic conduit of the work loop to the second hydraulic conduit of the work loop, and then from port B to port T, to return to the tank. In a third position of the motor directional control valve illustrated in FIG. 7, port P is coupled to port B and port T is coupled to port A, such that hydraulic fluid can flow from port P to port B, through the second hydraulic conduit of the work loop to the first hydraulic conduit of the work loop, and then from port A to port T, to return to the tank.

As the terminology is used herein, the work loop of a hydraulic system includes the hydraulic pathway(s) from a directional control valve that controls the flow of pressurized hydraulic fluid to a component that uses the pressurized hydraulic fluid to provide useful work to an end-user of the hydraulic system, and back from the component that uses the pressurized hydraulic fluid to the directional control valve. In normal operation, the work loop of the hydraulic system 100 may include the directional control valve 106, the fourth hydraulic conduit 118, the hydraulic motor 110, and the fifth hydraulic conduit 120.

The directional control valve 106 may be a cylinder directional control valve, and is selected and optimized for use in controlling the flow of hydraulic fluid to hydraulic cylinders either generating mechanical work in the form of linear motion or exerting linear "pushing" or "pulling" forces. The directional control valve 106 may not be, and the hydraulic system 100 and its work loop may not include, a motor directional control valve selected and optimized for use in controlling the flow of hydraulic fluid to hydraulic motors either generating mechanical work in the form of rotation or exerting rotational torques.

The hydraulic pump 104 has an inlet that is hydraulically coupled to the reservoir 102 by a first hydraulic pipeline or conduit 112 and an outlet that is hydraulically coupled to the inlet 106*a* of the directional control valve 106 by a second hydraulic pipeline or conduit 114. When in use, the hydraulic pump 104 can draw hydraulic fluid at a first, relatively low pressure from the reservoir 102 through the first conduit 112 and pump the hydraulic fluid out at a second, relatively high pressure, which can be greater than the first, relatively low pressure, to the inlet 106*a* of the directional control valve 106 through the second conduit 114. The outlet 106*b* of the directional control valve 106 is hydraulically coupled to the reservoir 102 by a third hydraulic pipeline or conduit 116.

The hydraulic motor 110 may be a bi-directional, variable displacement, winch hydraulic motor, and has a first fluid port 110*a* that is hydraulically coupled to the third fluid port 106*c* of the directional control valve 106 by a fourth hydraulic conduit 118 and a second fluid port 110*b* that is hydraulically coupled to the fourth fluid port 106*d* of the directional control valve 106 by a fifth hydraulic conduit 120. When the hydraulic system 100 is in use and when the directional control valve 106 is in the second position as described above, hydraulic fluid at the second, relatively high pressure is pumped by the hydraulic pump 104 through the second conduit 114 to the inlet 106*a* of the directional control valve 106, through the directional control valve 106 to the third port 106*c* of the directional control valve 106, which acts as an outlet to the directional control valve 106, and through the fourth conduit 118 to the first port 110*a* of the hydraulic motor 110, which acts as an inlet to the motor 110.

The relatively high-pressure hydraulic fluid then flows through the hydraulic motor 110 to its second port 110*b*, which acts as an outlet to the motor 110, powering and driving operation of the hydraulic motor 110 and losing hydraulic pressure and returning to, or returning approximately to, the first, relatively low pressure. The hydraulic fluid then flows through the fifth hydraulic conduit 120 to the fourth fluid port 106*d* of the directional control valve 106, which acts as an inlet to the directional control valve 106, and through the directional control valve 106 to the outlet 106*b* of the directional control valve 106. The hydraulic fluid then flows through the third hydraulic conduit 116 and returns to the reservoir 102.

When the hydraulic system 100 is in use and when the directional control valve 106 is in the third position as described above, hydraulic fluid at the second, relatively high pressure is pumped by the hydraulic pump 104 through the second conduit 114 to the inlet 106*a* of the directional control valve 106, through the directional control valve 106 to the fourth port 106*d* of the directional control valve 106, which acts as an outlet to the directional control valve 106, and through the fifth conduit 120 to the second port 110*b* of the hydraulic motor 110, which acts as an inlet to the motor 110.

The relatively high-pressure hydraulic fluid then flows through the hydraulic motor 110 to its first port 110*a*, which acts as an outlet to the motor 110, powering and driving operation of the hydraulic motor 110 and losing hydraulic pressure and returning to, or returning approximately to, the first, relatively low pressure. The hydraulic fluid then flows through the fourth hydraulic conduit 118 to the third fluid port 106*c* of the directional control valve 106, which acts as an inlet to the directional control valve 106, and through the directional control valve 106 to the outlet 106*b* of the directional control valve 106. The hydraulic fluid then flows through the third hydraulic conduit 116 and returns to the reservoir 102.

When the hydraulic system 100 is in operation and the directional control valve 106 is in either the second or the third position described above, the pressurized hydraulic fluid pumped through the system 100 by the pump 104 is used to drive operation of the hydraulic motor 110, which converts energy from the hydraulic fluid to rotation of an output shaft 122. The shaft 122 has a first end coupled to the motor 110, and a second end opposite the first coupled to a spool 124 of a mechanical device such as a winch. When the hydraulic system 100 is in operation and the directional control valve 106 is in the second position described above, the hydraulic motor 110 drives the shaft 122 and the spool 124 to rotate about their own central longitudinal axes in a first direction, such as clockwise or counter-clockwise. When the hydraulic system 100 is in operation and the directional control valve 106 is in the third position described above, the hydraulic motor 110 drives the shaft 122 and the spool 124 to rotate about their own central longitudinal axes in a second direction opposite the first direction, such as counter-clockwise or clockwise.

Thus, in practice, the position of the directional control valve 106 generally controls the direction of a rotation of, and/or the direction of a torque transmitted by, the shaft 122. More specifically, the position of the directional control valve 106 ultimately controls the direction of rotation of the spool 124, and thereby controls whether a winch, of which the spool 124 is a part, is reeling in or reeling out. The position of the directional control valve 106 can thus be switched between the second and third positions described above to switch operation of a winch from reeling out to reeling in or from reeling in to reeling out.

As noted above, the directional control valve 106 may be a cylinder directional control valve and not a motor directional control valve, and the hydraulic system 100 may not include any motor directional control valves, despite the hydraulic system 100 using a hydraulic motor 110 to drive rotation of the shaft 122 and of the spool 124. As a result, the directional control valve 106 may be optimized for use with hydraulic cylinders rather than for use with the hydraulic motor 110 and in fact may have characteristics detrimental to the operation of the hydraulic motor 110.

Indeed, in practice, it has been found that many of the directional control valves 106 included in hydraulic systems of new, e.g., late model year, heavy equipment, or other related components thereof, create or result in backpressures that are much higher than those created by or resulting from the operation of traditional motor directional control valves, and that are undesirably high due to their reduction of the pressure differential generated between the first and second fluid ports 110*a* and 110*b* of the hydraulic motor 110. In practice, cylinder-type directional control valves may be more likely to have high internal flow constriction or restriction than motor-type directional control valves, but individual models of both types of directional control valves may or may not display high internal flow constrictions or restrictions. Hydraulically-powered machine subsystems and/or hydraulically-powered attachments employing hydraulic cylinders may in many cases be less sensitive to such backpressures than hydraulically-powered subsystems and/or hydraulically-powered attachments employing hydraulic motors. It may also be relatively easier in most cases to overcome the negative impacts of high backpressure with hydraulically-powered subsystems and/or hydraulically-powered attachments employing cylinders than hydraulically-powered subsystems and/or hydraulically-powered attachments employing motors. However, both types of hydraulically-powered subsystems and/or hydraulically-powered attachments may be sensitive to high backpressure and/or both may require significant effort to mitigate the negative impacts of high back pressure.

The overall performance of the hydraulic motor 110, and thus any mechanical device it powers, such as a winch including the spool 124, such as the torque they are capable of producing, depends directly on the pressure differential provided between the first and second fluid ports 110*a* and 110*b* (winches may be high-power, continuous high-flow implements). Thus, the reduction in that pressure differential resulting from backpressure caused by a restrictive directional control valve, or caused by any other source of system back pressure, directly diminishes the overall performance of the motor 110 and any mechanical component coupled thereto and driven thereby, such as a winch including the spool 124. Nevertheless, it would generally be difficult or impossible to permanently divert flow of hydraulic fluid around the directional control valve 106, at least because doing so can interfere or conflict with one or more other originally intended functions of the hydraulic system 100.

Thus, the hydraulic system 100 also includes a sixth pipeline or conduit 128 having a first end hydraulically coupled to the fourth conduit 118 and a second end opposite the first end hydraulically coupled to the bypass valve 108, a seventh pipeline or conduit 130 having a first end hydraulically coupled to the fifth conduit 120 and a second end opposite the first end hydraulically coupled to the bypass valve 108, and a bypass pipeline or conduit 126 having a first end hydraulically coupled to the bypass valve 108 and a second end opposite the first end hydraulically coupled to the reservoir 102, to allow hydraulic fluid to return from either the fourth conduit 118 or the fifth conduit 120 to the reservoir 102 without passing through the directional control valve 106. Depending on the configuration or position of the bypass valve 108, hydraulic fluid can flow from either the fourth conduit 118 but not the fifth conduit 120, or the fifth conduit 120 but not the fourth conduit 118, directly to the reservoir 102, without passing through the directional control valve 106. Together, the sixth conduit 128, seventh conduit 130, bypass conduit 126, and bypass valve 108 allow hydraulic fluid to intermittently bypass, in an "on-demand" manner, the directional control valve 106 and/or other fluid constrictions that are causing high backpressures, such as in response to measurements of the backpressure exceeding threshold pressures.

As illustrated in FIG. 5, the hydraulic system 100 also includes a first pressure sensor 132 coupled to the fourth hydraulic conduit 118 to measure a pressure of the hydraulic fluid within the fourth hydraulic conduit 118, and a second pressure sensor 134 coupled to the fifth hydraulic conduit 120 to measure a pressure of the hydraulic fluid within the fifth hydraulic conduit 120. The first and second pressure sensors 132 and 134 can be communicatively coupled, such as by a first communications line 136 and a second communications line 138, respectively, to the bypass valve 108. The bypass valve 108 can be configured to be actuated, such as by a pilot hydraulic, electro-hydraulic (solenoid over pilot hydraulic), or pure-electric or pure-electrical (direct solenoid or servo) actuator, or by direct action, to switch between its valve positions, such as in response to or based on the measurements taken by the first and/or second pressure sensors 132 and 134. The bypass valve 108 can be controlled based on measurements of backpressure(s), and actuated when the backpressure(s) exceed a threshold backpressure, or based on measurements of a work loop or other pressure differential (such as across a work device), and actuated when the measured pressure differential is below a predetermined minimum threshold pressure differential or above a predetermined maximum threshold pressure differential, or based directly or indirectly on commands received from a human operator or an Electronic Control Module (ECM), or based on the detection or measurement of any other conditions indicative of or correlated with excessively high backpressures.

In some implementations, the pressure sensors 132 and 134 and the communications lines 136 and 138 can be implemented as or replaced by hydraulic conduits that hydraulically couple the hydraulic fluid in the fourth and fifth conduits 118 and 120, respectively, to hydraulic actuator(s) of the bypass valve 108. In such implementations, the pressures in, or the pressure differential between, the hydraulic fluid within the fourth and fifth conduits 118 and 120 can directly control operation of the bypass valve 108 to allow hydraulic fluid to flow from the work loop to the tank 102, such as at a rate that is proportional to one of the measured pressures or the degree to which one of the measured pressures exceeds the threshold pressure, or at a rate that is proportional to the pressure differential between the hydraulic fluid within the fourth and fifth conduits 118 and 120, or at a rate that is proportional to the degree the measured pressure differential differs from a threshold pressure differential. In some implementations, any of the valves described herein may be configured to be actuated to switch directly between a fully open position and a fully closed position instead of allowing the hydraulic fluid to flow at variable rates that may be maintained proportional to measurements taken within the system.

The bypass valve 108 can be operated to move between first, second, and third configurations or positions thereof based on the pressures measured by the first and second pressure sensors 132, 134. The bypass valve 108 is not a directional control valve as that term is used herein, and may not have the configuration of either a cylinder directional control valve or a motor directional control valve as described herein with respect to FIGS. 6 and 7. While the bypass valve 108 is shown as a three-port, three-position valve, the bypass valve 108 could be a valve with more than three physical ports and/or more than three physical positions but installed and/or used as a three-port, three position valve. Thus, as used herein, references to valves by their number of ports and/or number of positions include valves that include more than the specified number of physical ports and/or physical positions, if the valves are installed and/or used, or capable of being installed and/or used, as a valve with the specified number of ports and/or positions.

The bypass valve 108 is a three-port, three-position valve having a first inlet 108*a*, a second inlet 108*b*, and an outlet 108*c*. The bypass valve 108 can be operated in one of, and can be actuated to switch between, three distinct configurations or positions. In a first one of the positions, the bypass valve 108 is closed and no working fluid flows through the bypass valve 108 at all. In a second one of the positions, the first inlet 108*a* is fluidically coupled to the outlet 108*c*. In the second position, fluid can flow through the sixth conduit 128 from the fourth conduit 118 to the first inlet 108*a*, through the bypass valve 108 to the outlet 108*c*, and then through the bypass conduit 126 to the reservoir 102, thereby bypassing the directional control valve 106. In a third one of the positions, the second inlet 108*b* is fluidically coupled to the outlet 108*c*. In the third position, fluid can flow through the seventh conduit 130 from the fifth conduit 120 to the second inlet 108*b*, through the bypass valve 108 to the outlet 108*c*, and then through the bypass conduit 126 to the reservoir 102, thereby bypassing the directional control valve 106. As noted above, in some implementations, the bypass valve 108 can be operated to move partially from its first position to its second or third position, with the degree of its motion in such a direction proportional to the pressure differential between the hydraulic fluid within the fourth and fifth conduits 118 and 120 or proportional to the degree the measured pressure differential differs from a threshold pressure differential.

When the hydraulic system 100 is in operation and the directional control valve 106 is in its second position, as described above, the hydraulic fluid initially flows through the system 100 and returns to the reservoir 102 through the fifth conduit 120. In such cases, the pressure sensor 134 can be used to measure the backpressure in the hydraulic fluid flowing through the fifth conduit 120 from the motor 110 to the reservoir 102 (or, as noted above, the pressure sensors 132 and 134 can be used to measure the pressure differential between the hydraulic fluid in the fourth and fifth conduits 118 and 120). As long as the backpressure measured by the pressure sensor 134 (or the pressure differential measured) remains below an acceptable threshold pressure (or above a predetermined minimum threshold pressure differential or below a predetermined maximum threshold pressure differential), the bypass valve 108 may be kept in its first, closed position.

If the backpressure measured by the pressure sensor 134 in the fifth conduit 120 exceeds the acceptable threshold pressure, then the bypass valve 108 is switched to its third position, such that hydraulic fluid travels from the fifth conduit 120, through the bypass valve 108 and the bypass conduit 126, to the reservoir 102, without passing through the directional control valve 106. If the pressure differential measured by the pressure sensors 132 and 134 (or other relevant measured pressure differential) is below a predetermined minimum threshold pressure differential or above a predetermined maximum threshold pressure differential, then the bypass valve 108 is moved toward its third position by an amount proportional to the degree the measured pressure differential differs from the threshold pressure differential. Doing so relieves the backpressure developed within the fifth conduit 120 and thereby increases the pressure differential between the first and second fluid ports 110*a*, 110*b* of the motor 110, thereby increasing performance of the motor 110 and any mechanical device coupled thereto and driven thereby, such as a winch including the spool 124.

When the hydraulic system 100 is in operation and the directional control valve 106 is in its third position, as described above, the hydraulic fluid initially flows through the system 100 and returns to the reservoir 102 through the fourth conduit 118. In such cases, the pressure sensor 132 can be used to measure the backpressure in the hydraulic fluid flowing through the fourth conduit 118 from the motor 110 to the reservoir 102 (or, as noted above, the pressure sensors 132 and 134 can be used to measure the pressure differential between the hydraulic fluid in the fourth and fifth conduits 118 and 120). As long as the backpressure measured by the pressure sensor 132 (or the pressure differential measured) remains below an acceptable threshold pressure (or above a predetermined minimum threshold pressure differential or below a predetermined maximum threshold pressure differential), the bypass valve 108 may be kept in its first, closed position.

If the backpressure measured by the pressure sensor 132 in the fourth conduit 118 exceeds the acceptable threshold pressure, then the bypass valve 108 is switched to its second position, such that hydraulic fluid travels from the fourth conduit 118, through the bypass valve 108 and the bypass conduit 126, to the reservoir 102, without passing through the directional control valve 106. If the pressure differential measured by the pressure sensors 132 and 134 (or other relevant measured pressure differential) is below a predetermined minimum threshold pressure differential or above a predetermined maximum threshold pressure differential, then the bypass valve 108 is moved toward its second position by an amount proportional to the degree the measured pressure differential differs from the threshold pressure differential. Doing so relieves the backpressure developed within the fourth conduit 118 and thereby increases the pressure differential between the first and second fluid ports 110*a*, 110*b* of the motor 110, thereby increasing performance of the motor 110 and any mechanical device coupled thereto and driven thereby, such as a winch including the spool 124.

The back pressure thresholds, predetermined minimum threshold pressure differentials, and/or predetermined maximum threshold pressure differentials described herein may be 100 psi, 125 psi, 150 psi, 175 psi, 200 psi, 225 psi, 250 psi, 275 psi, 300 psi, 325 psi, 350 psi, 375 psi, 400 psi, 425 psi, 450 psi, 475 psi, 500 psi, 525 psi, 550 psi, 575 psi, 600 psi, and/or intermediate or higher pressures as appropriate. The pressure thresholds described herein may be less than 100 psi, 125 psi, 150 psi, 175 psi, 200 psi, 225 psi, 250 psi, 275 psi, 300 psi, 325 psi, 350 psi, 375 psi, 400 psi, 425 psi, 450 psi, 475 psi, 500 psi, 525 psi, 550 psi, 575 psi, or 600 psi. The pressure thresholds described herein may be greater than 100 psi, 125 psi, 150 psi, 175 psi, 200 psi, 225 psi, 250 psi, 275 psi, 300 psi, 325 psi, 350 psi, 375 psi, 400 psi, 425 psi, 450 psi, 475 psi, 500 psi, 525 psi, 550 psi, 575 psi, or 600 psi.

Figure 8:
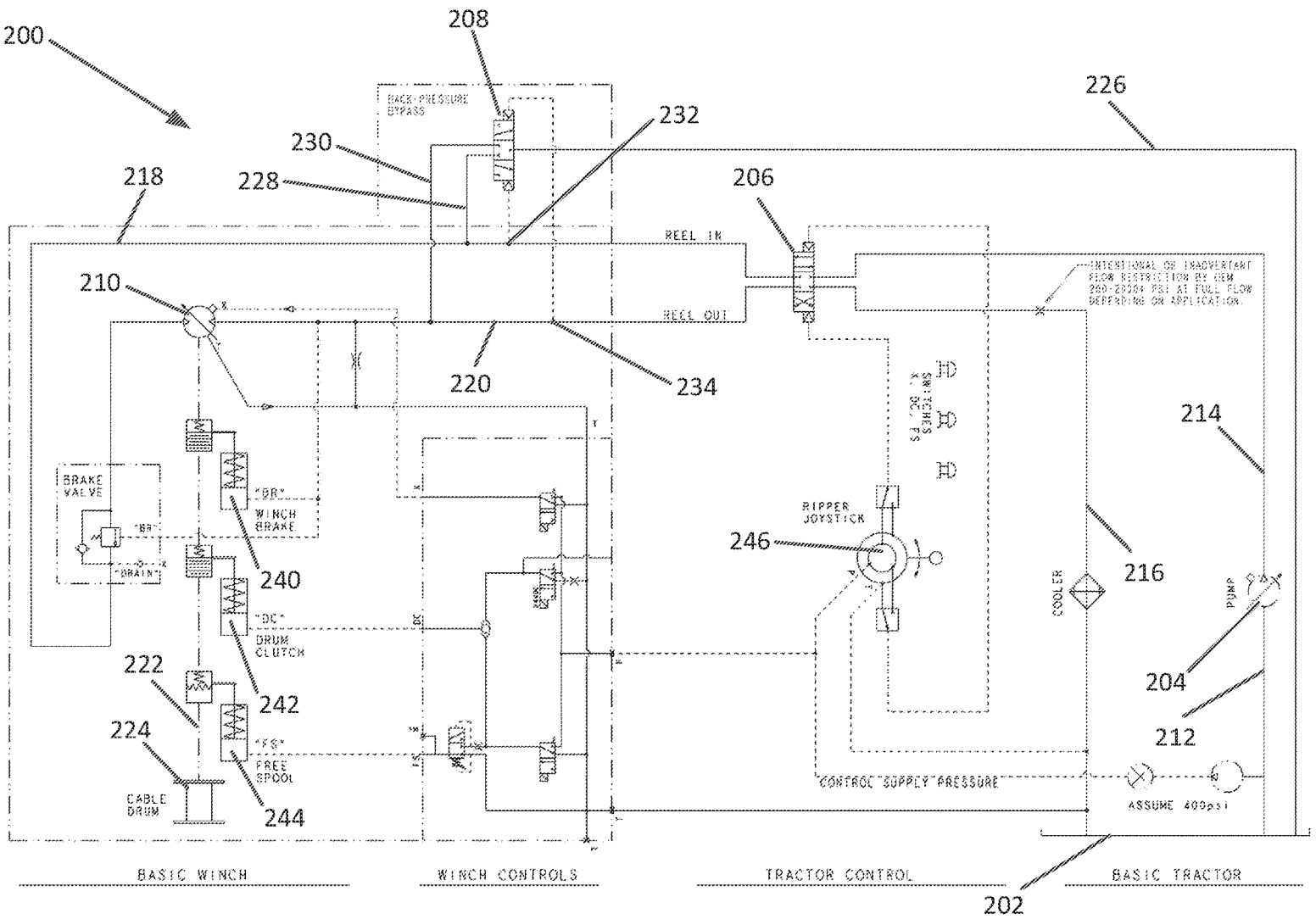
FIG. 8 illustrates a schematic diagram of another hydraulic system.
Figure 9:
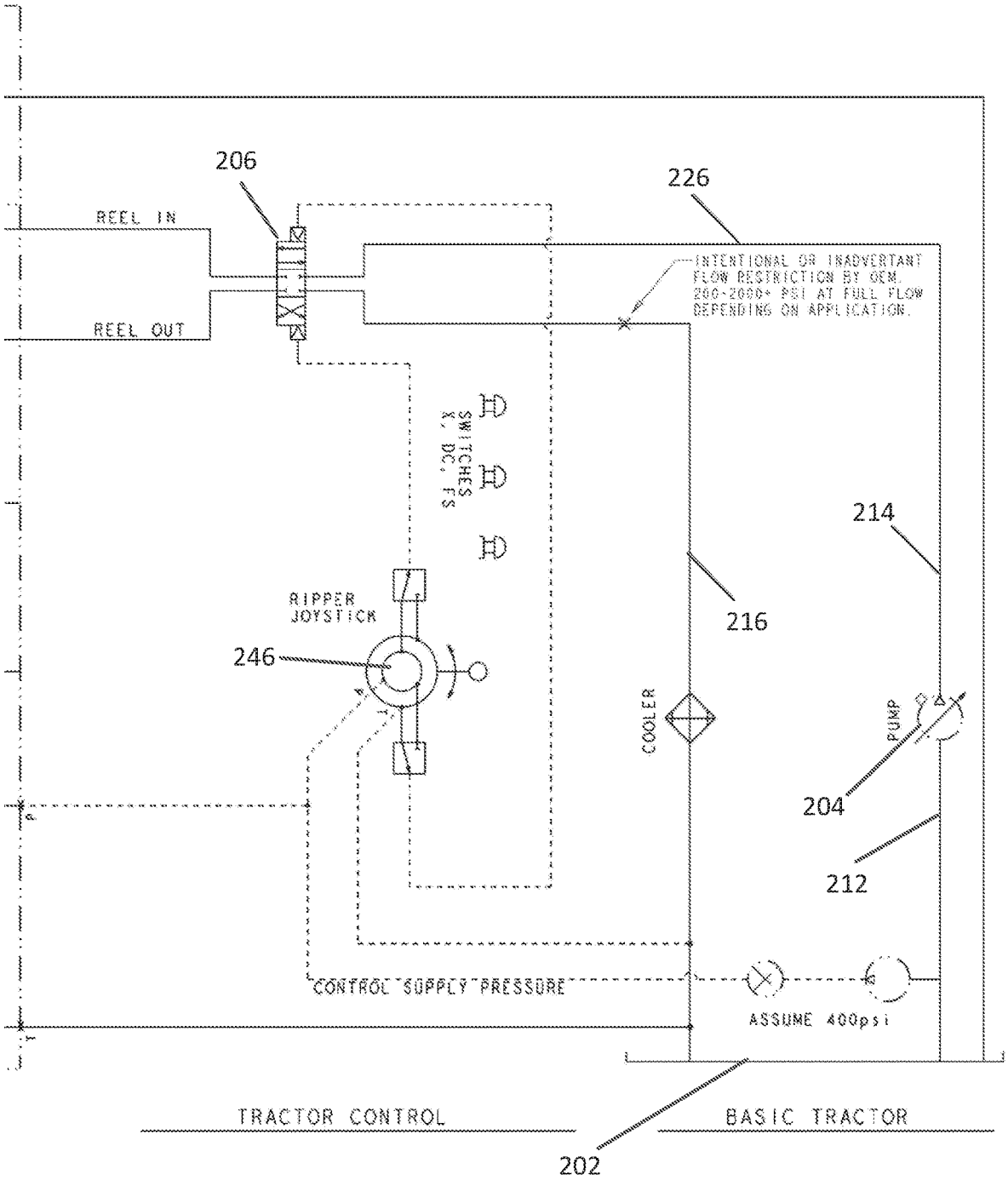
FIG. 9 illustrates a larger view of a portion of the schematic diagram of FIG. 8.
Figure 10:
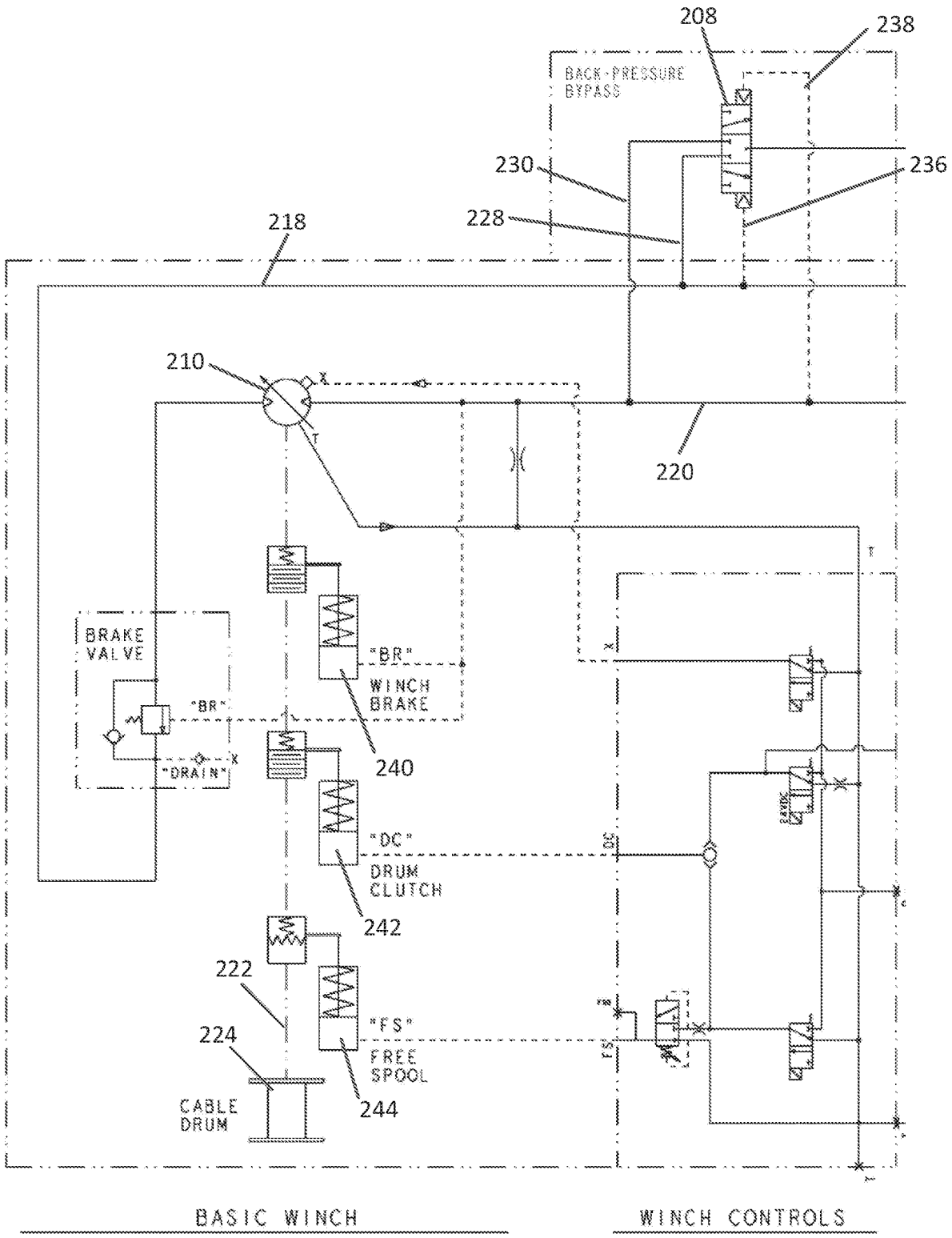
FIG. 10 illustrates a larger view of another portion of the schematic diagram of FIG. 8.

FIG. 8 illustrates a schematic diagram of another hydraulic system 200 that incorporates features illustrated in and described with respect to FIG. 5. FIG. 9 illustrates a first portion of the diagram of FIG. 8 at a larger scale, and FIG. 10 illustrates a second portion of the diagram of FIG. 8 at a larger scale. As illustrated in FIGS. 8-10, the hydraulic system 200 includes a work loop and components similar to those described above for system 100, and unless stated or illustrated otherwise herein, the components of hydraulic system 200 may have any of the features, characteristics, or behavior of the corresponding components of the hydraulic system 100.

As illustrated in FIGS. 8-10, the hydraulic system 200 includes a tank or reservoir 202 of hydraulic fluid, which corresponds to the reservoir 102, as well as a hydraulic pump 204 that corresponds to the hydraulic pump 104, a directional control valve 206 that corresponds to the directional control valve 106, a bypass valve 208 that corresponds to the bypass valve 108, and a hydraulic motor 210 that corresponds to the hydraulic motor 110. The hydraulic system 200 also includes a first hydraulic conduit 212 that hydraulically couples the reservoir 202 to the pump 204 and that corresponds to the first hydraulic conduit 112, a second hydraulic conduit 214 that hydraulically couples the pump 204 to the directional control valve 206 and that corresponds to the second hydraulic conduit 114, a third hydraulic conduit 216 that hydraulically couples the directional control valve 206 to the reservoir 202 and that corresponds to the third hydraulic conduit 116, a fourth hydraulic conduit 218 that hydraulically couples the directional control valve 206 to the hydraulic motor 210 and that corresponds to the fourth hydraulic conduit 118, and a fifth hydraulic conduit 220 that couples the hydraulic motor 210 to the directional control valve 206 and that corresponds to the fifth hydraulic conduit 120.

The hydraulic system 200 also includes an output shaft 222 driven by the hydraulic motor 210 and that corresponds to the output shaft 122, and a spool 224 coupled to the shaft 222 and that corresponds to the spool 124. The hydraulic system 200 also includes a bypass conduit 226 that hydraulically couples the bypass valve 208 to the reservoir 202 and that corresponds to the bypass conduit 126, a sixth conduit 228 that couples the fourth conduit 218 to the bypass valve 208 and that corresponds to the sixth conduit 128, a seventh conduit 230 that couples the fifth conduit 220 to the bypass valve 208 and that corresponds to the seventh conduit 130, a first pressure sensor 232 coupled to the fourth conduit 218 and that corresponds to the first pressure sensor 132, and a second pressure sensor 234 coupled to the fifth conduit 220 and that corresponds to the second pressure sensor 134.

FIGS. 8-10 also illustrate that the hydraulic system 200 includes additional components not illustrated in hydraulic system 100 in FIG. 5, including hydraulic components that are not part of the hydraulic system 100. For example, FIGS. 8-10 illustrate that hydraulic system 200 includes a winch brake 240, a drum clutch 242, and a free spool 244, as well as a joystick 246 for controlling various components of the hydraulic system 200. Some of these components can be relatively low-hydraulic flow devices and can be particularly sensitive to hydraulic backpressures, if they are encountered.

Figure 3:
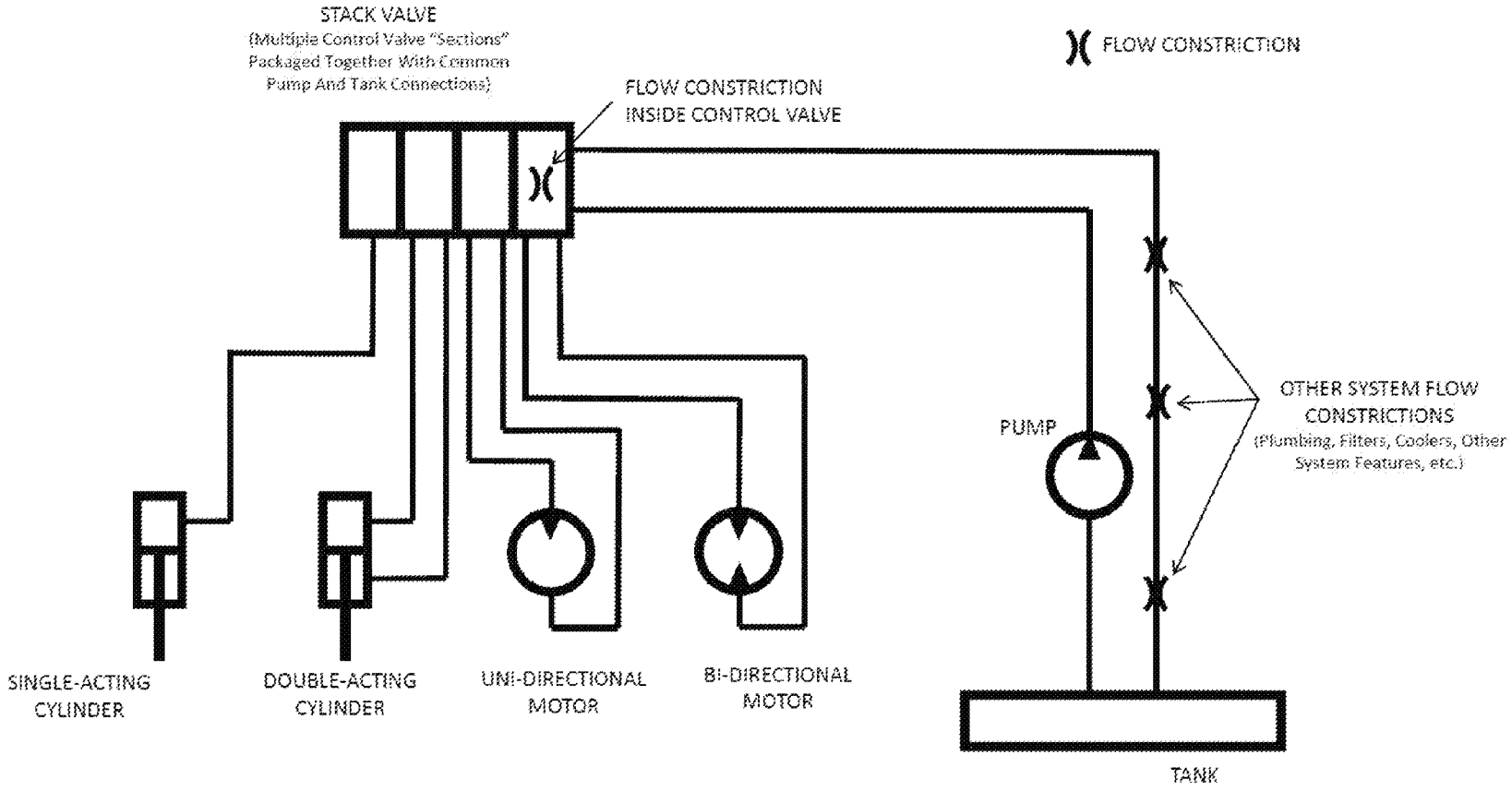
FIG. 3 illustrates a schematic diagram of another hydraulic system.
Figure 4:
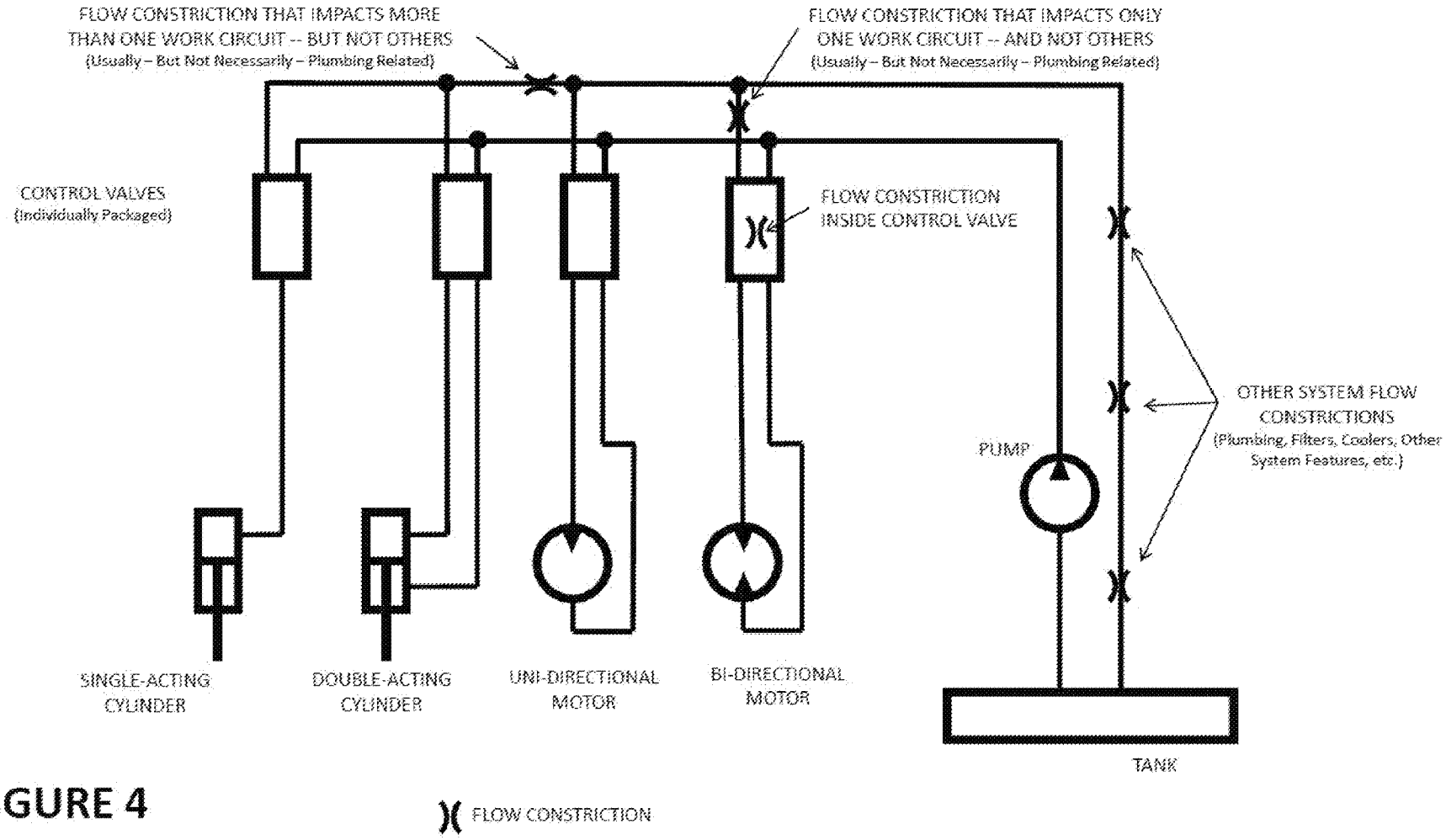
FIG. 4 illustrates a schematic diagram of another hydraulic system.
Figure 11:
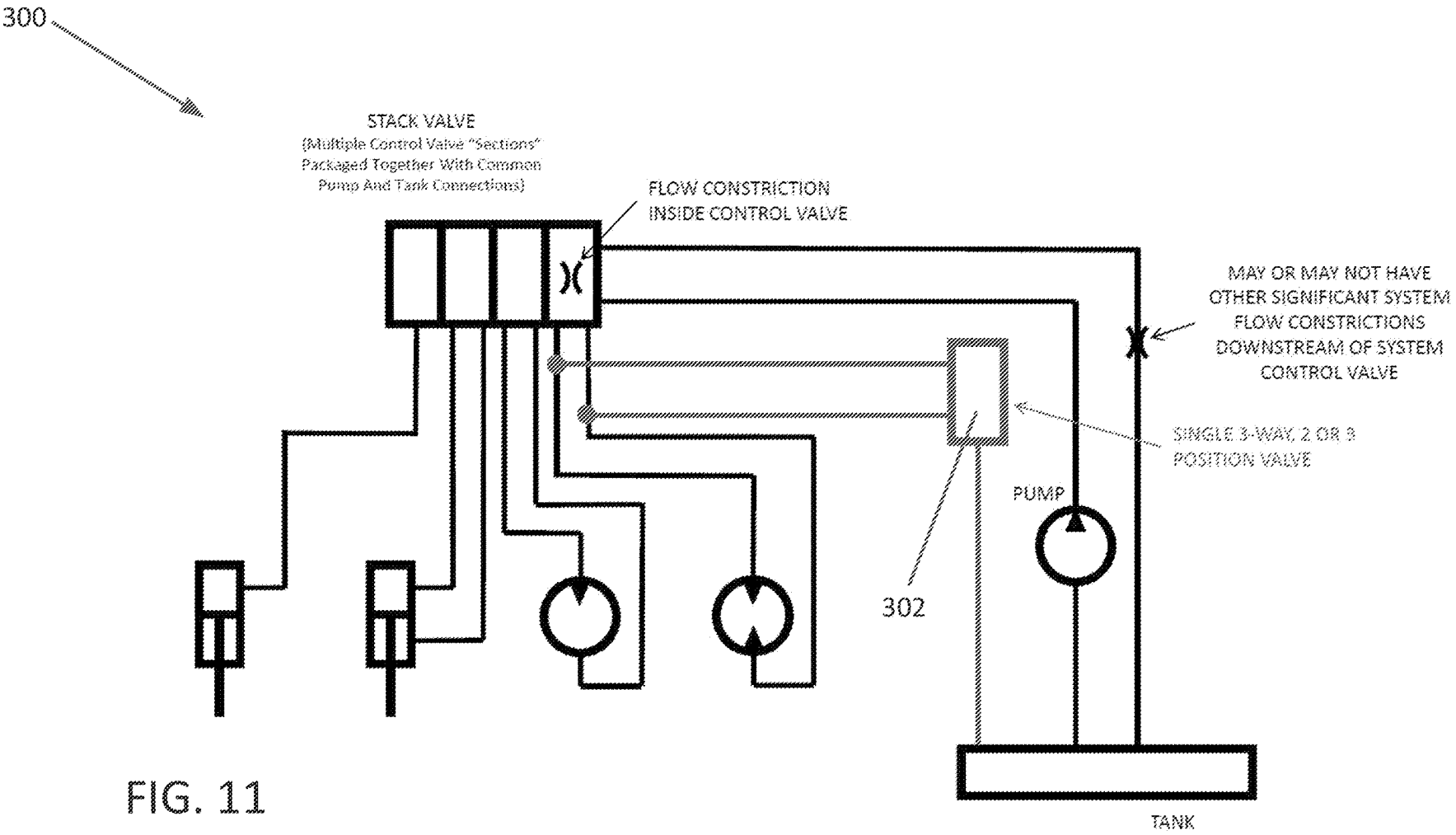
FIG. 11 illustrates a schematic diagram of another hydraulic system.

FIG. 11 illustrates a schematic diagram of another hydraulic system 300 similar to the hydraulic system illustrated in FIG. 3, but which incorporates features illustrated in and described with respect to FIGS. 5 and 8-10. As illustrated in FIG. 11, the hydraulic system 300 includes a work loop and components similar to those described above for systems 100 and 200, and unless stated or illustrated otherwise herein, the components of hydraulic system 300 may have any of the features, characteristics, or behavior of the corresponding components of the hydraulic systems 100 and/or 200.

As illustrated in FIG. 11, the hydraulic system 300 includes a tank or reservoir that corresponds to the reservoirs 102 and 202, a hydraulic pump that corresponds to the hydraulic pumps 104 and 204, a directional control valve that corresponds to the directional control valves 106 and 206, a bypass valve 302 that corresponds to the bypass valves 108 and 208, and a hydraulic motor that corresponds to the hydraulic motors 110 and 210, as well as a plurality of hydraulic conduits interconnecting such components in a manner similar to that described herein for systems 100 and 200. As illustrated in FIG. 11, the bypass valve 302 may be a single three-port, two- or three-position valve.

The hydraulic system 300 also includes a first pressure sensor that corresponds to the first pressure sensor 132 to measure a pressure of the hydraulic fluid within a hydraulic conduit that corresponds to the fourth hydraulic conduit 118, and a second pressure sensor that corresponds to the second pressure sensor 134 to measure a pressure of the hydraulic fluid within a hydraulic conduit that corresponds to the fifth hydraulic conduit 120. The first and second pressure sensors can be communicatively coupled, such as by a first communications line that corresponds to the first communications line 136 and a second communications line that corresponds to the second communications line 138, respectively, to the bypass valve 302.

Similar to the bypass valves 108 and 208, the bypass valve 302 can be configured to be actuated, such as by a pilot hydraulic, electro-hydraulic (solenoid over pilot hydraulic), or pure-electric or pure-electrical (direct solenoid or servo) actuator, or by direct action, to switch between its valve positions, such as in response to or based on appropriate absolute or differential pressure measurements, such as may be taken by the first and second pressure sensors. The bypass valve 302 can be controlled based on measurements of backpressure(s), and actuated when the backpressure(s) exceed a threshold backpressure, or based on measurements of a work loop pressure differential across a work device (or other appropriate pressure differential), and actuated when the measured (e.g., work loop) pressure differential is below a predetermined minimum threshold pressure differential or above a predetermined maximum threshold pressure differential, or based directly or indirectly on commands received from a human operator or an Electronic Control Module (ECM), or based on the detection or measurement of any other conditions indicative of or correlated with excessively high backpressures.

In some implementations, the pressure sensors and the communications lines can be implemented as or replaced by hydraulic conduits that hydraulically couple the hydraulic fluid in the conduits that correspond to the fourth and fifth conduits 118 and 120, to hydraulic actuator(s) of the bypass valve 302. In such implementations, the pressures in, or the pressure differential between, the hydraulic fluid within the conduits that correspond to the fourth and fifth conduits 118 and 120 can directly control operation of the bypass valve 302 to allow hydraulic fluid to flow from the work loop to the tank, such as at a rate that is proportional to one of the measured pressures or the degree to which one of the measured pressures exceeds the threshold pressure, or at a rate that is proportional to the pressure differential between the hydraulic fluid within the conduits that correspond to the fourth and fifth conduits 118 and 120, or at a rate that is proportional to the degree the measured pressure differential differs from a threshold pressure differential.

Figure 12:
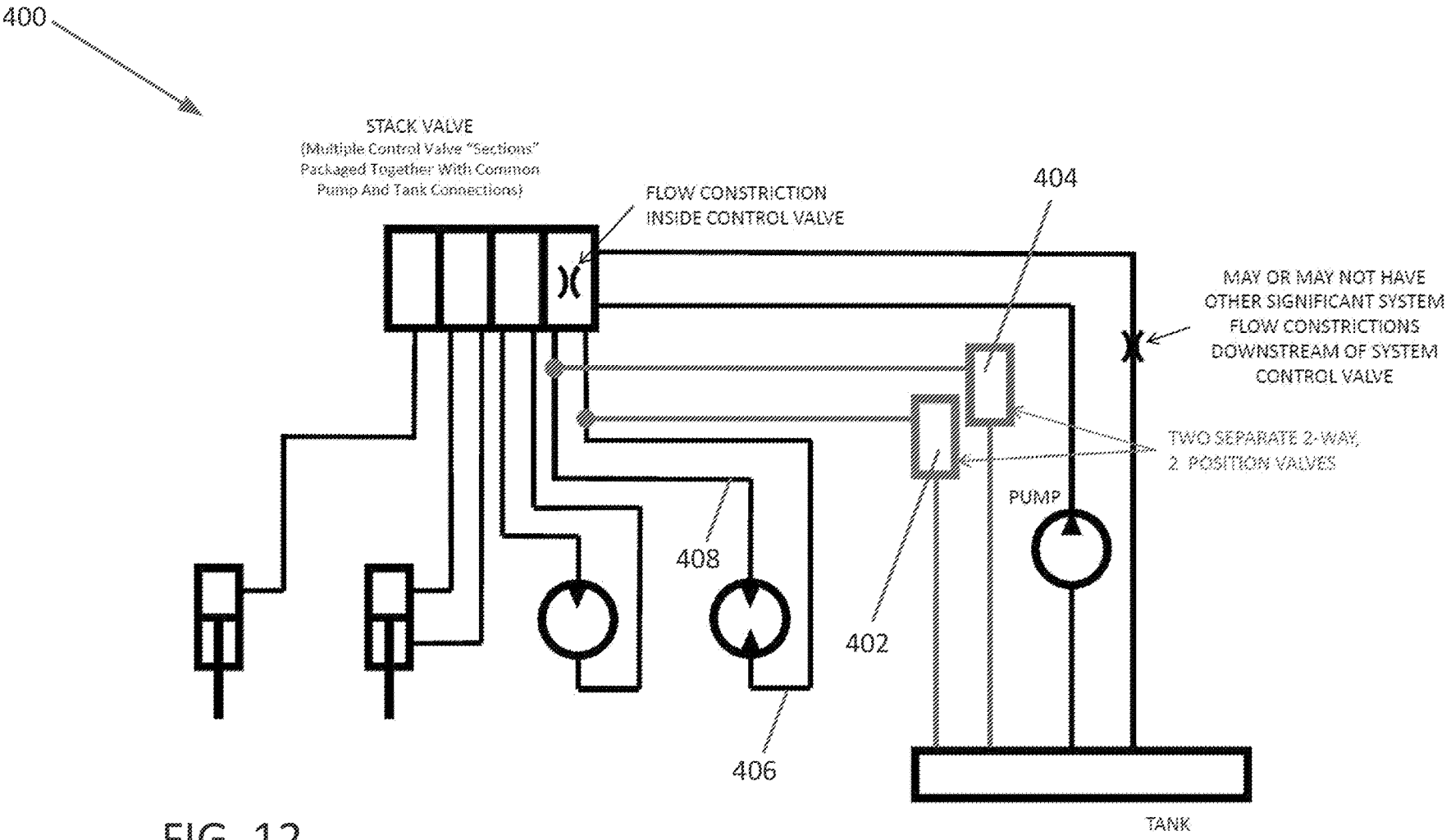
FIG. 12 illustrates a schematic diagram of another hydraulic system.

FIG. 12 illustrates a schematic diagram of another hydraulic system 400 similar to the hydraulic system illustrated in FIG. 3, but which incorporates features illustrated in and described with respect to FIGS. 5 and 8-10. As illustrated in FIG. 12, the hydraulic system 400 includes a work loop and components similar to those described above for systems 100 and 200, and unless stated or illustrated otherwise herein, the components of hydraulic system 400 may have any of the features, characteristics, or behavior of the corresponding components of the hydraulic systems 100 and/or 200.

As illustrated in FIG. 12, the hydraulic system 400 includes a tank or reservoir that corresponds to the reservoirs 102 and 202, a hydraulic pump that corresponds to the hydraulic pumps 104 and 204, a directional control valve that corresponds to the directional control valves 106 and 206, a first bypass valve 402 and a second bypass valve 404 that together correspond to or replace the bypass valves 108 and 208, and a hydraulic motor that corresponds to the hydraulic motors 110 and 210, as well as a plurality of hydraulic conduits interconnecting such components in a manner similar to that described herein for systems 100 and 200, including a fourth conduit 406 that couples the directional control valve to the motor and corresponds to the fourth conduits 118 and 218, and a fifth conduit 408 that couples the directional control valve to the motor and corresponds to the fifth conduits 120 and 220.

The first bypass valve 402 may be a single two-port, two-position valve, where in a first position the first bypass valve 402 is closed and in a second position the first bypass valve 402 is open. A first port of the first bypass valve 402 is hydraulically coupled to the fourth conduit 406, and a second port of the first bypass valve 402 is hydraulically coupled to the reservoir of hydraulic fluid. The second bypass valve 404 may be a single two-port, two-position valve, where in a first position the second bypass valve 404 is closed and in a second position the second bypass valve 404 is open. A first port of the second bypass valve 404 is hydraulically coupled to the fifth conduit 408, and a second port of the second bypass valve 404 is hydraulically coupled to the reservoir of hydraulic fluid.

While the bypass valves 402 and 404 are two-port, two-position valves, the bypass valves 402 and 404 could be valves with more than two physical ports and/or more than two physical positions but installed and/or used as two-port, two position valves. Thus, as used herein, references to valves by their number of ports and/or number of positions include valves that include more than the specified number of physical ports and/or physical positions, if the valves are installed and/or used, or capable of being installed and/or used, as a valve with the specified number of ports and/or positions.

While the hydraulic system 400 is in operation and the directional control valve is in its second position, as described above, one or two pressure sensors corresponding to the pressure sensors described above with respect to system 100 can be used to measure the backpressure in the hydraulic fluid flowing through the hydraulic system 400 from the motor to the reservoir (or, as noted above, two pressure sensors corresponding to those described above with respect to system 100 can be used to measure any appropriate pressure differentials, such as a pressure differential between the hydraulic fluid in opposing sides of the work loop). As long as the backpressure measured by the pressure sensor(s) (or the pressure differential measured) remains below an acceptable threshold pressure (or above a predetermined minimum threshold pressure differential or below a predetermined maximum threshold pressure differential), the bypass valves 402 and 404 may be kept in their first, closed positions.

If the backpressure measured in the fifth conduit 408 exceeds the acceptable threshold pressure, then the bypass valve 404 is switched to its second, open position, such that hydraulic fluid travels through the bypass valve 404 to the reservoir, without passing through the directional control valve, thereby bypassing the cause of the high backpressure. If the pressure differential measured by the pressure sensors is below a predetermined minimum threshold pressure differential or above a predetermined maximum threshold pressure differential, then the bypass valve 404 is moved toward its second position by an amount proportional to the degree the measured pressure differential differs from the threshold pressure differential. Doing so relieves the backpressure developed within the fifth conduit 408 and thereby increases the pressure differential between the fluid ports of the motor, thereby increasing performance of the motor and any mechanical device coupled thereto and driven thereby, such as a winch including a spool.

While the hydraulic system 400 is in operation and the directional control valve is in its third position, as described above, one or two pressure sensors corresponding to the pressure sensors described above with respect to system 100 can be used to measure the backpressure in the hydraulic fluid flowing through the hydraulic system 400 from the motor to the reservoir (or, as noted above, two pressure sensors corresponding to those described above with respect to system 100 can be used to measure any appropriate pressure differential, such as a pressure differential between the hydraulic fluid in opposing sides of the work loop). As long as the backpressure measured by the pressure sensor(s) (or the pressure differential measured) remains below an acceptable threshold pressure (or above a predetermined minimum threshold pressure differential or below a predetermined maximum threshold pressure differential), the bypass valves 402 and 404 may be kept in their first, closed positions.

If the backpressure measured in the fourth conduit 406 exceeds the acceptable threshold pressure, then the bypass valve 402 is switched to its second, open position, such that hydraulic fluid travels through the bypass valve 402 to the reservoir, without passing through the directional control valve, thereby bypassing the cause of the high backpressure. If the pressure differential measured by the pressure sensors is below a predetermined minimum threshold pressure differential or above a predetermined maximum threshold pressure differential, then the bypass valve 402 is moved toward its second position by an amount proportional to the degree the measured pressure differential differs from the threshold pressure differential. Doing so relieves the backpressure developed within the fourth conduit 406 and thereby increases the pressure differential between the fluid ports of the motor, thereby increasing performance of the motor and any mechanical device coupled thereto and driven thereby, such as a winch including a spool.

The bypass valves 402 and 404 can be configured to be actuated, such as by a pilot hydraulic, electro-hydraulic (solenoid over pilot hydraulic), or pure-electric or pure-electrical (direct solenoid or servo) actuator, or by direct action, to switch between their respective valve positions, such as in response to or based on the measurements taken by the pressure sensors. The bypass valves 402 and 404 can be controlled based on measurements of backpressure(s), and actuated when the backpressure(s) exceed a threshold backpressure, or based on measurements of a work loop pressure differential across a work device or any other appropriate pressure differential, and actuated when the work loop pressure differential is below a predetermined minimum threshold pressure differential or above a predetermined maximum threshold pressure differential, or based on commands received from a human operator or an Electronic Control Module (ECM), or based on the detection or measurement of any other conditions indicative of or correlated with excessively high backpressures.

In some implementations, the pressure sensors can be implemented as or replaced by hydraulic conduits that hydraulically couple the hydraulic fluid in the conduits that correspond to the fourth and fifth conduits 118 and 120, to hydraulic actuator(s) of the bypass valves 402 and 404. In such implementations, the pressures in, or the pressure differential between, the hydraulic fluid within the conduits that correspond to the fourth and fifth conduits 118 and 120 can directly control operation of the bypass valves 402 and 404 to allow hydraulic fluid to flow from the work loop to the tank, such as at a rate that is proportional to one of the measured pressures or the degree to which one of the measured pressures exceeds the threshold pressure, or at a rate that is proportional to the pressure differential between the hydraulic fluid within the conduits that correspond to the fourth and fifth conduits 118 and 120, or at a rate that is proportional to the degree the measured pressure differential differs from a threshold pressure differential.

Figure 13:
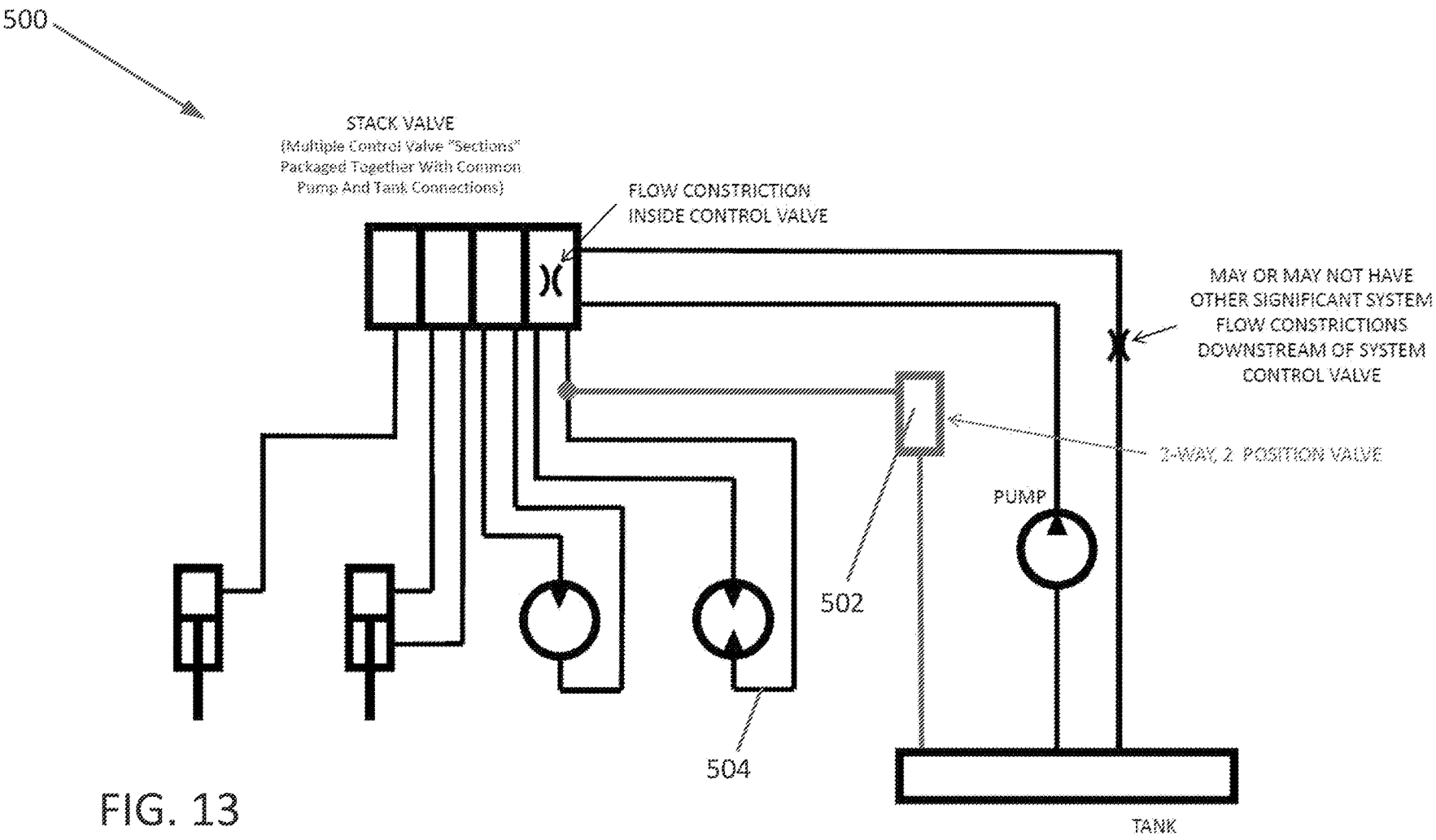
FIG. 13 illustrates a schematic diagram of another hydraulic system.

FIG. 13 illustrates a schematic diagram of another hydraulic system 500 similar to the hydraulic system illustrated in FIG. 3, but which incorporates features illustrated in and described with respect to FIGS. 5 and 8-10. As illustrated in FIG. 13, the hydraulic system 500 includes a work loop and components similar to those described above for systems 100 and 200, and unless stated or illustrated otherwise herein, the components of hydraulic system 500 may have any of the features, characteristics, or behavior of the corresponding components of the hydraulic systems 100 and/or 200.

As illustrated in FIG. 13, the hydraulic system 500 includes a tank or reservoir that corresponds to the reservoirs 102 and 202, a hydraulic pump that corresponds to the hydraulic pumps 104 and 204, a directional control valve that corresponds to the directional control valves 106 and 206, a single bypass valve 502 that corresponds to or replaces the bypass valves 108 and 208, and a hydraulic motor that corresponds to the hydraulic motors 110 and 210, as well as a plurality of hydraulic conduits interconnecting such components in a manner similar to that described herein for systems 100 and 200, including a conduit 504 that couples the directional control valve to the motor and corresponds to one of the fourth and fifth conduits 118, 218, 120, and 220. The bypass valve 502 may be a single two-port, two-position valve, where in a first position the bypass valve 502 is closed and in a second position the bypass valve 502 is open.

A first port of the bypass valve 502 is hydraulically coupled to the conduit 504, and a second port of the bypass valve 502 is hydraulically coupled to the reservoir of hydraulic fluid. The hydraulic system 500 may be particularly suited for use in situations where excessive backpressures are encountered primarily when the work loop is operated in one direction but not the other. Such situations may arise where absolute backpressures are higher when the work loop operates in one direction than when it operates in the other direction, or where a differential pressure is higher when the work loop operates in one direction than when it operates in the other direction (e.g., if hydraulic flow is only provided to the work loop in one direction, then there may only be an absolute back pressure or differential pressure in that direction and not in the opposite direction).

While the hydraulic system 500 is in operation, a single pressure sensor corresponding to one of the pressure sensors described above with respect to system 100 can be used to measure the backpressure in the hydraulic fluid flowing through the hydraulic system 500 from the motor to the reservoir (or, as noted above, two pressure sensors corresponding to those described above with respect to system 100 can be used to measure any appropriate pressure differential, such as a pressure differential between the hydraulic fluid in opposing sides of the work loop). As long as the backpressure measured by the pressure sensor(s) (or the pressure differential measured) remains below an acceptable threshold pressure (or above a predetermined minimum threshold pressure differential or below a predetermined maximum threshold pressure differential), the bypass valve 502 may be kept in its first, closed position.

If the backpressure measured in the conduit 504 exceeds the acceptable threshold pressure, then the bypass valve 502 is switched to its second, open position, such that hydraulic fluid travels through the bypass valve 502 to the reservoir, without passing through the directional control valve, thereby bypassing the cause of the high backpressure. If the pressure differential measured by the pressure sensors is below a predetermined minimum threshold pressure differential or above a predetermined maximum threshold pressure differential and the conduit 504 carries hydraulic fluid from the hydraulic motor to the directional control valve, then the bypass valve 502 is moved toward its second position by an amount proportional to the degree the measured pressure differential differs from the threshold pressure differential. Doing so relieves the backpressure developed within the conduit 504 and thereby increases the pressure differential between the fluid ports of the motor, thereby increasing performance of the motor and any mechanical device coupled thereto and driven thereby, such as a winch including a spool.

The bypass valve 502 can be configured to be actuated, such as by a pilot hydraulic, electro-hydraulic (solenoid over pilot hydraulic), or pure-electric or pure-electrical (direct solenoid or servo) actuator, or by direct action, to switch between its valve positions, such as in response to or based on the measurements taken by pressure sensors. The bypass valve 502 can be controlled based on measurements of backpressure(s), and actuated when the backpressure(s) exceed a threshold backpressure, or based on measurements of a work loop pressure differential across a work device or any other appropriate pressure differential, and actuated when the work loop pressure differential is below a predetermined minimum threshold pressure differential or above a predetermined maximum threshold pressure differential, or based directly or indirectly on commands received from a human operator or an Electronic Control Module (ECM), or based on the detection or measurement of any other conditions indicative of or correlated with excessively high backpressures.

In some implementations, the pressure sensors can be implemented as or replaced by hydraulic conduits that hydraulically couple the hydraulic fluid in the conduits that correspond to the fourth and fifth conduits 118 and 120, to hydraulic actuator(s) of the bypass valve 502. In such implementations, the pressures in, or the pressure differential between, the hydraulic fluid within the conduits that correspond to the fourth and fifth conduits 118 and 120 can directly control operation of the bypass valve 502 to allow hydraulic fluid to flow from the work loop to the tank, such as at a rate that is proportional to one of the measured pressures or the degree to which one of the measured pressures exceeds the threshold pressure, or at a rate that is proportional to the pressure differential between the hydraulic fluid within the conduits that correspond to the fourth and fifth conduits 118 and 120, or at a rate that is proportional to the degree the measured pressure differential differs from a threshold pressure differential.

Figure 14:
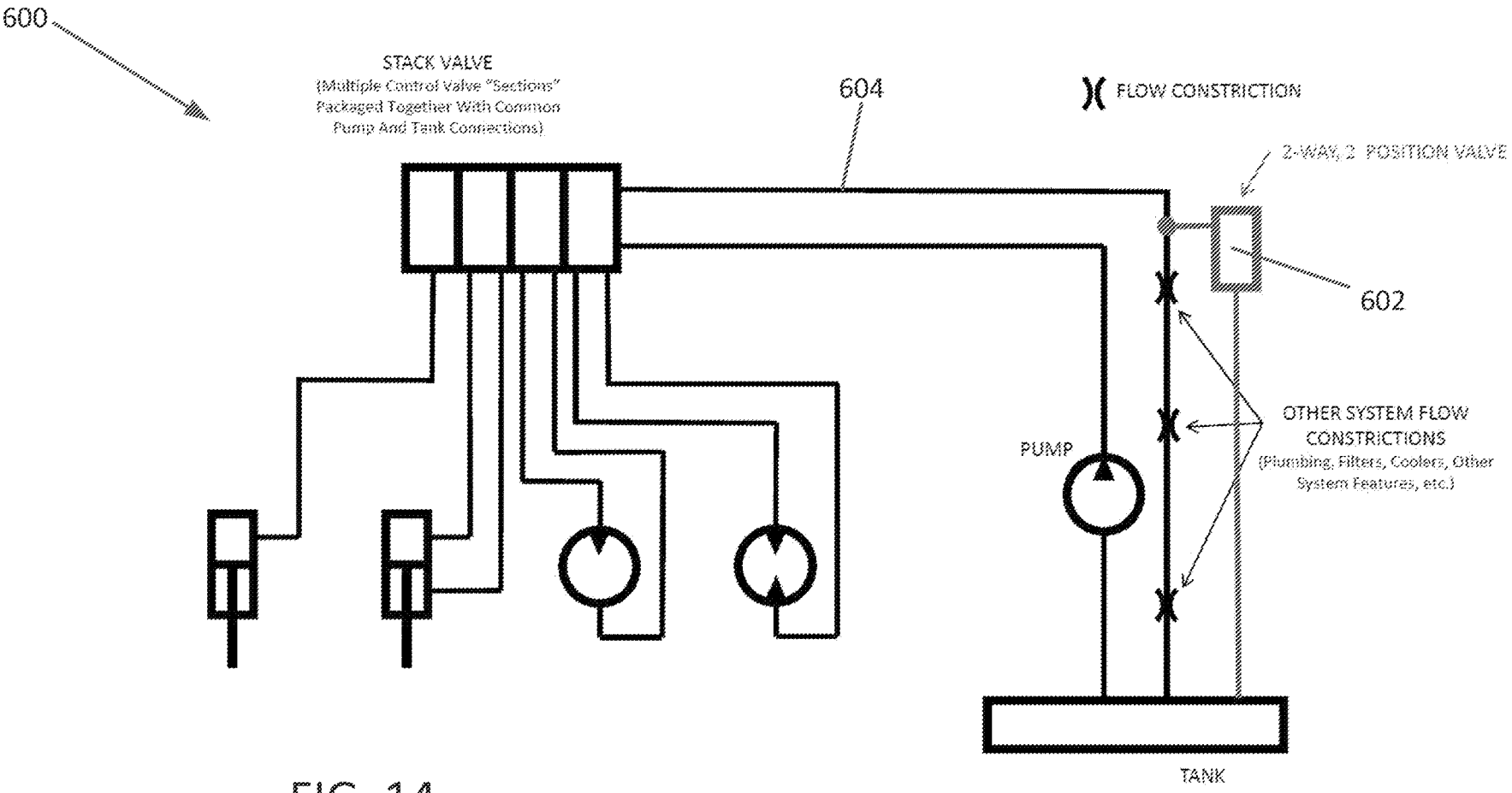
FIG. 14 illustrates a schematic diagram of another hydraulic system.

FIG. 14 illustrates a schematic diagram of another hydraulic system 600 similar to the hydraulic system illustrated in FIG. 3, but which incorporates features illustrated in and described with respect to FIGS. 5 and 8-10. As illustrated in FIG. 14, the hydraulic system 600 includes a work loop and components similar to those described above for systems 100 and 200, and unless stated or illustrated otherwise herein, the components of hydraulic system 600 may have any of the features, characteristics, or behavior of the corresponding components of the hydraulic systems 100 and/or 200.

As illustrated in FIG. 14, the hydraulic system 600 includes a tank or reservoir that corresponds to the reservoirs 102 and 202, a hydraulic pump that corresponds to the hydraulic pumps 104 and 204, a directional control valve that corresponds to the directional control valves 106 and 206, a single bypass valve 602 that corresponds to or replaces the bypass valves 108 and 208, and a hydraulic motor that corresponds to the hydraulic motors 110 and 210, as well as a plurality of hydraulic conduits interconnecting such components in a manner similar to that described herein for systems 100 and 200, including a conduit 604 that couples the directional control valve to the reservoir of hydraulic fluid and corresponds to the third conduit 116. The bypass valve 602 may be a single two-port, two-position valve, where in a first position the bypass valve 602 is closed and in a second position the bypass valve 602 is open.

A first port of the bypass valve 602 is hydraulically coupled to the conduit 604 at a location downstream of the directional control valve and upstream of one or more flow constrictions, and a second port of the bypass valve 602 is hydraulically coupled to the reservoir of hydraulic fluid. The hydraulic system 600 may be used in particular in situations where the flow constriction in the directional control valve is much smaller and has a much smaller effect on the operation of the hydraulic system 600 than flow constrictions downstream of the directional control valve. The hydraulic system 600 may be particularly suited for use in situations where it is easier, simpler, or more efficient to couple the bypass valve 602 to the rest of the hydraulic system 600 at a location downstream of the directional control valve rather than upstream of the directional control valve.

While the hydraulic system 600 is in operation, a single pressure sensor corresponding to one of the pressure sensors described above with respect to system 100 can be used to measure the backpressure in the hydraulic fluid flowing through the hydraulic system 600 from the motor to the reservoir (or, as noted above, two pressure sensors corresponding to those described above with respect to system 100 can be used to measure any appropriate pressure differential, such as a pressure differential between the hydraulic fluid in opposing sides of the work loop). As long as the backpressure measured by the pressure sensor(s) (or the pressure differential measured) remains below an acceptable threshold pressure (or above a predetermined minimum threshold pressure differential or below a predetermined maximum threshold pressure differential), the bypass valve 602 may be kept in its first, closed position.

If the backpressure measured in the hydraulic fluid flowing from the motor to the reservoir, such as in the conduit 604, exceeds the acceptable threshold pressure, then the bypass valve 602 is switched to its second, open position, such that hydraulic fluid travels through the bypass valve 602 to the reservoir, thereby bypassing the flow constrictions and the cause of the high backpressure. If the pressure differential measured by the pressure sensors is below a predetermined minimum threshold pressure differential or above a predetermined maximum threshold pressure differential, then the bypass valve 602 is moved toward its second, open position by an amount proportional to the degree the measured pressure differential differs from the threshold pressure differential. Doing so relieves the backpressure developed within the conduit 604 and thereby increases the pressure differential between the fluid ports of the motor, thereby increasing performance of the motor and any mechanical device coupled thereto and driven thereby, such as a winch including a spool.

The bypass valve 602 can be configured to be actuated, such as by a pilot hydraulic, electro-hydraulic (solenoid over pilot hydraulic), or pure-electric or pure-electrical (direct solenoid or servo) actuator, or by direct action, to switch between its valve positions, such as in response to or based on the measurements taken by pressure sensors. The bypass valve 602 can be controlled based on measurements of backpressure(s), and actuated when the backpressure(s) exceed a threshold backpressure, or based on measurements of a work loop pressure differential across a work device or any other appropriate pressure differential, and actuated when the work loop pressure differential is below a predetermined minimum threshold pressure differential or above a predetermined maximum threshold pressure differential, or based on commands received from a human operator or an Electronic Control Module (ECM), or based on the detection or measurement of any other conditions indicative of or correlated with excessively high backpressures.

In some implementations, the pressure sensors can be implemented as or replaced by hydraulic conduits that hydraulically couple the hydraulic fluid in the conduits that correspond to the fourth and fifth conduits 118 and 120, to hydraulic actuator(s) of the bypass valve 602. In such implementations, the pressures in, or the pressure differential between, the hydraulic fluid within the conduits that correspond to the fourth and fifth conduits 118 and 120 can directly control operation of the bypass valve 602 to allow hydraulic fluid to flow from the work loop to the tank, such as at a rate that is proportional to one of the measured pressures or the degree to which one of the measured pressures exceeds the threshold pressure, or at a rate that is proportional to the pressure differential between the hydraulic fluid within the conduits that correspond to the fourth and fifth conduits 118 and 120, or at a rate that is proportional to the degree the measured pressure differential differs from a threshold pressure differential.

Figure 15:
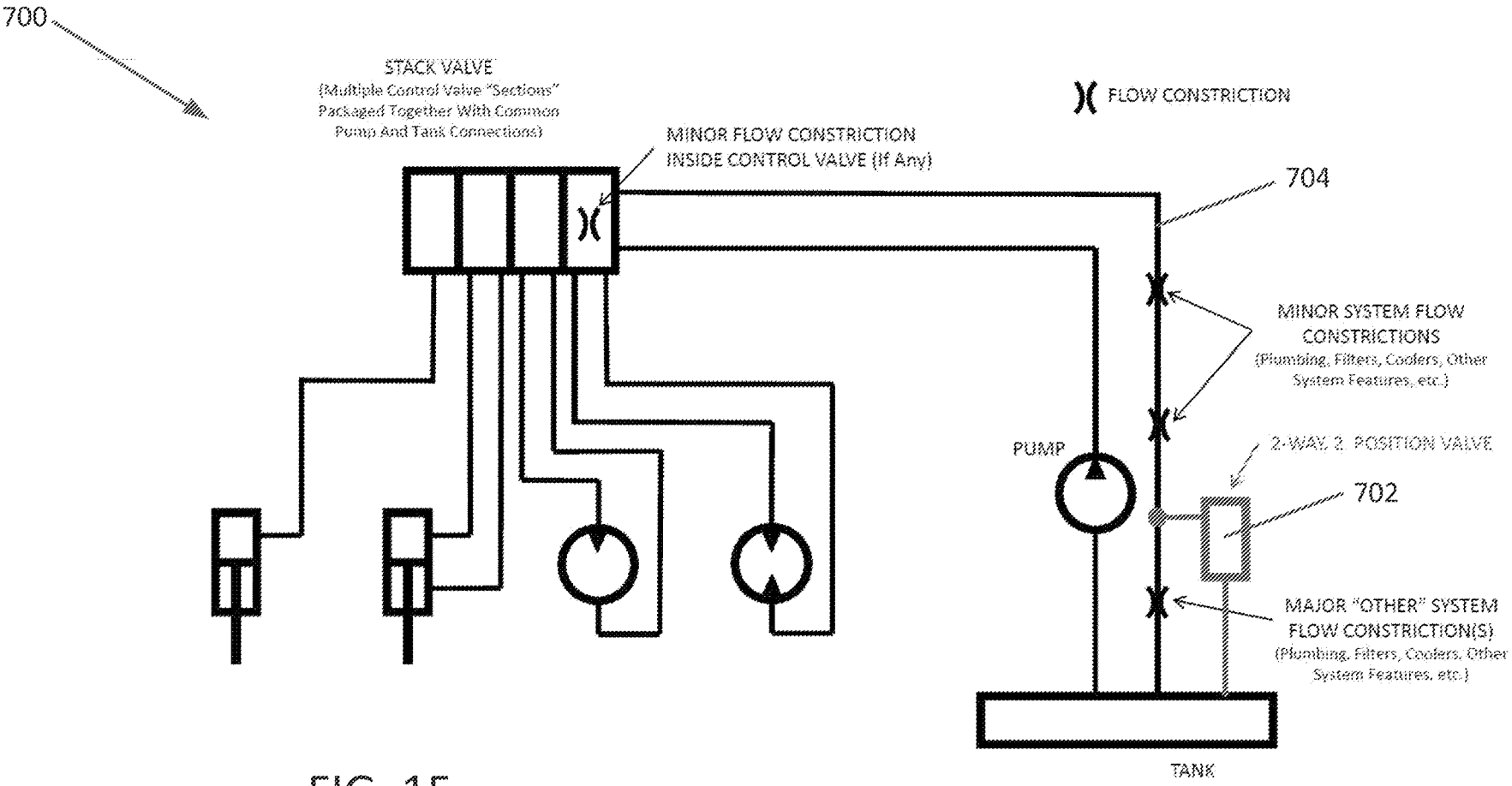
FIG. 15 illustrates a schematic diagram of another hydraulic system.

FIG. 15 illustrates a schematic diagram of another hydraulic system 700 similar to the hydraulic system illustrated in FIG. 3, but which incorporates features illustrated in and described with respect to FIGS. 5 and 8-10. As illustrated in FIG. 15, the hydraulic system 700 includes a work loop and components similar to those described above for systems 100 and 200, and unless stated or illustrated otherwise herein, the components of hydraulic system 700 may have any of the features, characteristics, or behavior of the corresponding components of the hydraulic systems 100 and/or 200.

As illustrated in FIG. 15, the hydraulic system 700 includes a tank or reservoir that corresponds to the reservoirs 102 and 202, a hydraulic pump that corresponds to the hydraulic pumps 104 and 204, a directional control valve that corresponds to the directional control valves 106 and 206, a single bypass valve 702 that corresponds to or replaces the bypass valves 108 and 208, and a hydraulic motor that corresponds to the hydraulic motors 110 and 210, as well as a plurality of hydraulic conduits interconnecting such components in a manner similar to that described herein for systems 100 and 200, including a conduit 704 that couples the directional control valve to the reservoir of hydraulic fluid and corresponds to the third conduit 116. The bypass valve 702 may be a single two-port, two-position valve, where in a first position the bypass valve 702 is closed and in a second position the bypass valve 702 is open.

A first port of the bypass valve 702 is hydraulically coupled to the conduit 704 at a location downstream of the directional control valve (including a flow constriction, if present) and of one or more flow constriction(s) downstream of the directional control valve, as well as upstream of one or more additional flow constrictions, and a second port of the bypass valve 702 is hydraulically coupled to the reservoir of hydraulic fluid. The hydraulic system 700 may be used in particular in situations where the flow constriction in the directional control valve and the one or more flow constriction(s) downstream of the directional control valve are much smaller and have a much smaller effect on the operation of the hydraulic system 700 than other additional flow constrictions further downstream. The hydraulic system 700 may be particularly suited for use in situations where it is easier, simpler, or more efficient to couple the bypass valve 702 to the rest of the hydraulic system 700 at a location downstream of the directional control valve and downstream of early and relatively minor additional flow constriction(s) downstream of the directional control valve rather than upstream of such features.

While the hydraulic system 700 is in operation, a single pressure sensor corresponding to one of the pressure sensors described above with respect to system 100 can be used to measure the backpressure in the hydraulic fluid flowing through the hydraulic system 700 from the motor to the reservoir (or, as noted above, two pressure sensors corresponding to those described above with respect to system 100 can be used to measure any appropriate pressure differential, such as a pressure differential between the hydraulic fluid in opposing sides of the work loop). As long as the backpressure measured by the pressure sensor(s) (or the pressure differential measured) remains below an acceptable threshold pressure (or is above a predetermined minimum threshold pressure differential or below a predetermined maximum threshold pressure differential), the bypass valve 702 may be kept in its first, closed position.

If the backpressure measured in the hydraulic fluid flowing from the motor to the reservoir, such as in the conduit 704, exceeds the acceptable threshold pressure, then the bypass valve 702 is switched to its second, open position, such that hydraulic fluid travels through the bypass valve 702 to the reservoir, thereby bypassing the downstream flow constrictions and cause of the high backpressure. If the pressure differential measured by the pressure sensors is below a predetermined minimum threshold pressure differential or above a predetermined maximum threshold pressure differential, then the bypass valve 702 is moved toward its second, open position by an amount proportional to the degree the measured pressure differential differs from the threshold pressure differential. Doing so relieves the backpressure developed within the conduit 704 and thereby increases the pressure differential between the fluid ports of the motor, thereby increasing performance of the motor and any mechanical device coupled thereto and driven thereby, such as a winch including a spool.

The bypass valve 702 can be configured to be actuated, such as by a pilot hydraulic, electro-hydraulic (solenoid over pilot hydraulic), or pure-electric or pure-electrical (direct solenoid or servo) actuator, or by direct action, to switch between its valve positions, such as in response to or based on the measurements taken by pressure sensors. The bypass valve 702 can be controlled based on measurements of backpressure(s), and actuated when the backpressure(s) exceed a threshold backpressure, or based on measurements of a work loop pressure differential across a work device or any other appropriate pressure differential, and actuated when the work loop pressure differential is below a predetermined minimum threshold pressure differential or above a predetermined maximum threshold pressure differential, or based on commands received from a human operator or an Electronic Control Module (ECM), or based on the detection or measurement of any other conditions indicative of or correlated with excessively high backpressures.

In some implementations, the pressure sensors can be implemented as or replaced by hydraulic conduits that hydraulically couple the hydraulic fluid in the conduits that correspond to the fourth and fifth conduits 118 and 120, to hydraulic actuator(s) of the bypass valve 702. In such implementations, the pressures in, or the pressure differential between, the hydraulic fluid within the conduits that correspond to the fourth and fifth conduits 118 and 120 can directly control operation of the bypass valve 702 to allow hydraulic fluid to flow from the work loop to the tank, such as at a rate that is proportional to one of the measured pressures or the degree to which one of the measured pressures exceeds the threshold pressure, or at a rate that is proportional to the pressure differential between the hydraulic fluid within the conduits that correspond to the fourth and fifth conduits 118 and 120, or at a rate that is proportional to the degree the measured pressure differential differs from a threshold pressure differential.

The systems described herein may include additional components, features, and systems, including filtration, cooling, and/or sensing systems, depending on the needs of the systems. The hydraulic systems of the present disclosure are described as driving operation of a spool of a winch (which may be a tail winch). A winch is a mechanical device that allows an operator to dispense or pull cable in a horizontal or generally horizontal direction, and may be distinguished from a hoist in that hoists allow operators to dispense or pull cable in a vertical or generally vertical direction. Thus, hoists are used to lift loads overhead, while winches are not. As a result of their different functions, winches and the cables used therewith are typically provided with break-away components, such as to allow a run-away load to break away from the winch, saving the winch and other equipment it is coupled to, while hoists are not.

The hydraulic systems of the present disclosure can be used to drive operation of a variety of other mechanical components or devices, which may be referred to as work devices or work systems, and are particularly useful for driving operation of, or powering, devices that are significantly negatively affected by high work loop back pressure. Examples of devices that could be used with the hydraulic systems of the present disclosure in place of the winch and spool 124 or 224 include hydraulic motor-driven pipelayer drawworks, wheel drives, track drives, swing drives, chippers, tillers, grinders, sweepers, hoists, capstans, fans, and steering systems, each of which may be driven by one or more hydraulic motors. In some implementations, devices that could be used with the hydraulic systems of the present disclosure in place of the winch and spool 124 or 224 include hydraulic cylinder-driven rippers, movable booms, movable blades, grapples, and steering systems, each of which may be driven by one or more hydraulic cylinders.

The hydraulic systems of the present disclosure may be components of larger systems, such as pieces of mobile, heavy equipment or heavy machinery, or a tractor, which may drive across the ground surface or otherwise be used to move loads from one place to another or otherwise perform or do useful mechanical work. More specifically, the hydraulic systems of the present disclosure may be incorporated into track-type or wheeled machinery, construction equipment, or vehicles, including tractors, skidders, bulldozers, pipelayers, loaders (including skid-steer loaders backhoe loaders, track loaders and compact track loaders), graders, backhoes, harvesters, feller-bunchers, forwarders, road planers, hay balers, cranes, and on-road or off-road trucks.

In some embodiments, the hydraulic systems described herein may be incorporated into track-type tractor-based heavy equipment. As used in the field of heavy construction and forestry equipment generally, and herein specifically, the terminology track-type tractor refers to the undercarriage, drive train, and other essential components of many types of heavy equipment, with bulldozers being a classic example. Track-type tractor-based heavy equipment is equipment whose fundamental purpose or function is to move across the ground, often pushing, pulling, or moving other objects. As examples, a track-type tractor-based bulldozer often moves across the ground to push objects from one place to another, a track-type tractor-based pipe layer often moves across the ground to move pipes from one place to another, and a track-type tractor-based skidder often moves across the ground to move logs from one place to another. This can be contrasted with other types of equipment, such as excavators and other excavator-based equipment (including excavator-based pipe layers), where by design and/or normal use the tracked or wheeled undercarriage will generally remain stationary while performing their fundamental functions, as well as with other types of equipment, such as road planers and hay balers, that are designed to move while performing their fundamental function, but for which movement across the ground is independent of the performance of their fundamental function, and/or movement across the ground is not the fundamental function of the equipment.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method of operating a piece of heavy equipment including a track-type tractor, comprising:

using the piece of heavy equipment to do mechanical work;

switching a position of a directional control valve to allow a hydraulic fluid to flow from a hydraulic pump through the directional control valve;

pumping the hydraulic fluid from a reservoir of the hydraulic fluid, through the directional control valve a first time, through a work loop including a hydraulic actuator, through the directional control valve a second time, and back to the reservoir;

using the hydraulic actuator to drive operation of a winch; and in response to a hydraulic backpressure created by a flow constriction exceeding a threshold pressure, switching a bypass valve to an open position to allow the hydraulic fluid to flow from the hydraulic actuator, through the bypass valve, and back to the reservoir without passing through the flow constriction.

2. The method of claim 1 wherein using the piece of heavy equipment to do mechanical work includes driving the piece of heavy equipment to do mechanical work.

3. The method of claim 1 wherein using the piece of heavy equipment to do mechanical work includes using the piece of heavy equipment to move a load.

4. The method of claim 1 wherein the piece of heavy equipment is a bulldozer.

5. The method of claim 1 wherein the piece of heavy equipment is a track-type tractor-based pipelayer.

6. The method of claim 1 wherein the threshold pressure is at least 100 psi.

7. A method of operating a skidder comprising:

using the skidder to do mechanical work;

switching a position of a directional control valve to allow a hydraulic fluid to flow from a hydraulic pump through the directional control valve;

pumping the hydraulic fluid from a reservoir of the hydraulic fluid, through the directional control valve a first time, through a hydraulic actuator, through the directional control valve a second time, and back to the reservoir;

using the hydraulic actuator to drive operation of a winch; and in response to a hydraulic backpressure created by a flow constriction exceeding a threshold pressure, switching a bypass valve to an open position to allow the hydraulic fluid to flow from the hydraulic actuator, through the bypass valve, and back to the reservoir without passing through the flow constriction.

8. The method of claim 7 wherein the skidder is a wheel skidder.

9. The method of claim 7 wherein the skidder is a track skidder.

10. A piece of heavy equipment comprising:

a track-type tractor;

a reservoir of hydraulic fluid;

a hydraulic pump;

a hydraulic directional control valve;

a hydraulic bypass valve;

a hydraulic actuator;

a winch mechanically coupled to be driven by the hydraulic actuator;

a first hydraulic conduit that hydraulically couples the hydraulic pump to the reservoir;

a second hydraulic conduit that hydraulically couples the hydraulic pump to the directional control valve;

a third hydraulic conduit that hydraulically couples the directional control valve to the reservoir;

a fourth hydraulic conduit that hydraulically couples the directional control valve to the hydraulic actuator;

a fifth hydraulic conduit that hydraulically couples the directional control valve to the hydraulic actuator;

a sixth hydraulic conduit that hydraulically couples either the third hydraulic conduit or the fourth hydraulic conduit to the bypass valve; and a bypass conduit that hydraulically couples the bypass valve to the reservoir.

11. The piece of heavy equipment of claim 10, wherein the winch includes a break-away component.

12. The piece of heavy equipment of claim 10, wherein when the hydraulic actuator is in operation, the fourth hydraulic conduit is downstream of the hydraulic actuator and the fifth hydraulic conduit is upstream of the hydraulic actuator.

13. The piece of heavy equipment of claim 10, further comprising:

a flow constriction in either the third hydraulic conduit or the fourth hydraulic conduit;

wherein the sixth hydraulic conduit is hydraulically coupled to the third hydraulic conduit or to the fourth hydraulic conduit at a joint that is downstream of the hydraulic actuator; and wherein the flow constriction is downstream of the joint.

14. A skidder comprising:

a reservoir of hydraulic fluid;

a hydraulic pump;

a hydraulic directional control valve;

a hydraulic bypass valve;

a hydraulic actuator;

a winch mechanically coupled to be driven by the hydraulic actuator;

a first hydraulic conduit that hydraulically couples the hydraulic pump to the reservoir;

a second hydraulic conduit that hydraulically couples the hydraulic pump to the directional control valve;

a third hydraulic conduit that hydraulically couples the directional control valve to the reservoir;

a fourth hydraulic conduit that hydraulically couples the directional control valve to the hydraulic actuator;

a fifth hydraulic conduit that hydraulically couples the directional control valve to the hydraulic actuator;

a sixth hydraulic conduit that hydraulically couples either the third hydraulic conduit or the fourth hydraulic conduit to the bypass valve; and a bypass conduit that hydraulically couples the bypass valve to the reservoir.

15. The skidder of claim 14, wherein the winch includes a break-away component.

16. The skidder of claim 14, wherein when the hydraulic actuator is in operation, the fourth hydraulic conduit is downstream of the hydraulic actuator and the fifth hydraulic conduit is upstream of the hydraulic actuator.

17. The skidder of claim 14, further comprising:

a flow constriction in either the third hydraulic conduit or the fourth hydraulic conduit;

wherein the sixth hydraulic conduit is hydraulically coupled to the third hydraulic conduit or to the fourth hydraulic conduit at a joint that is downstream of the hydraulic actuator; and wherein the flow constriction is downstream of the joint.

* * * * *